US010135108B2

(12) United States Patent
Uemichi

(10) Patent No.: US 10,135,108 B2
(45) Date of Patent: Nov. 20, 2018

(54) DIRECTIONAL COUPLER AND DIPLEXER

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 15/189,411

(22) Filed: Jun. 22, 2016

(65) Prior Publication Data

US 2016/0380331 A1 Dec. 29, 2016

(30) Foreign Application Priority Data

Jun. 24, 2015 (JP) ..... 2015-126655
Jun. 2, 2016 (JP) ..... 2016-111192

(51) Int. Cl.
*H01P 5/18* (2006.01)
*H01P 3/12* (2006.01)

(52) U.S. Cl.
CPC ..... *H01P 5/182* (2013.01)

(58) Field of Classification Search
CPC .. H01P 5/18; H01P 5/181; H01P 5/182; H01P 3/12; H01P 3/123
USPC ..... 333/109–113, 122
See application file for complete search history.

(56) References Cited

U.S. PATENT DOCUMENTS 2,739,287 A 3/1956 Riblet
2,739,288 A * 3/1956 Riblet ..... H01P 5/182 333/113
3,056,096 A 9/1962 Vane
4,686,493 A * 8/1987 Chang ..... H01P 1/182 333/113
4,688,006 A 8/1987 Wong et al.
4,691,177 A * 9/1987 Wong ..... H01P 1/122 333/105
4,812,788 A * 3/1989 Wong ..... H01P 5/182 333/113
4,818,964 A * 4/1989 Wong ..... H01P 5/04 333/113
5,043,684 A * 8/1991 Downs ..... H01P 5/182 333/113

(Continued)

FOREIGN PATENT DOCUMENTS

CN 87102309 A 12/1987
CN 1864340 A 11/2006

(Continued)

OTHER PUBLICATIONS

Akihiro Hino et al., "A Design of Broad-Band Compact H-Plane Directional Couplers", Institute of Electronics, Information and Communication Engineers, Technical, Reoprt of IEICE., 2000-163, (Dec. 2000), pp. 85-92.

(Continued)

*Primary Examiner* — Dean Takaoka
(74) *Attorney, Agent, or Firm* — Westerman, Hattori, Daniels & Adrian, LLP

(57) ABSTRACT

In a directional coupler, a rectangular waveguide includes a second narrow wall and has a width varying part resulting from the second narrow wall protruding toward a first narrow wall, the width varying part including at least a portion of an opening, the protruding part protruding by a protrusion amount larger at the center of the width varying part than at both ends thereof.

5 Claims, 24 Drawing Sheets

(56) References Cited

U.S. PATENT DOCUMENTS

| | | | | |
|---|---|---|---|---|
| 6,057,747 | A * | 5/2000 | Takenoshita | H01P 1/02 333/137 |
| 6,882,244 | B2 * | 4/2005 | Stenberg | H01P 1/122 333/109 |
| 7,064,633 | B2 * | 6/2006 | Wu | H01P 5/082 333/230 |
| 7,821,355 | B2 * | 10/2010 | Engel | H01P 1/211 333/117 |
| 7,973,616 | B2 * | 7/2011 | Shijo | H01P 3/121 333/113 |
| 8,324,983 | B2 * | 12/2012 | Brandau | H01P 5/182 333/113 |
| 2005/0070232 | A1 | 3/2005 | Mages | |
| 2009/0303145 | A1 | 12/2009 | Shoji et al. | |
| 2016/0380330 | A1 * | 12/2016 | Uemichi | H04B 1/0057 333/110 |

FOREIGN PATENT DOCUMENTS

| | | | |
|---|---|---|---|
| CN | 203085728 | U | 7/2013 |
| JP | 49-65755 | A | 6/1974 |
| JP | 2009-296376 | A | 12/2009 |

OTHER PUBLICATIONS

Office Action dated Aug. 2, 2016, issued in counterpart Japanese Patent Application No. 2016-111192, with English translation. (10 pages).

Office Action dated Oct. 25, 2016, issued in counterpart Japanese Patent Application No. 2016-111192, with English translation. (3 pages).

Hao et al., "Single-layer substrate integrated waveguide directional couplers", Microwaves, Antennas and Propagation, IEE Proceedings, vol. 153, No. 5, pp. 426-431, Oct. 2006, cited in Specification (6 pages).

Chen et al., "Development of a Low Cost Microwave Mixer Using a Broad-band Substrate Integrated Waveguide (SIW) Coupler", IEEE Microwave and Wireless Components Letters, vol. 16, No. 2, pp. 84-86, Feb. 2006, cited in Specification (3 pages).

Hino, A. et al., Proceedings of the 2000 Electronics Society Conference of IEICE, p. 97.

Office Action dated Apr. 3, 2018, issued in counterpart Japanese Application No. 2016-195962, with English Translation. (6 pages).

Office Action dated Oct. 31, 2017, issued in counterpart Japanese Application No. 2016-195962, with English machine translation. (5 pages).

Office Action dated May 29, 2018, issued in counterpart Chinese Application No. 201610464246.3, with English translation. (15 pages).

Notice of Allowance dated Jul. 24, 2018, issued in counterpart Japanese Application No. 2016-195962, with English translation. (4 pages).

* cited by examiner

DIRECTIONAL COUPLER AND DIPLEXER

This Nonprovisional application claims priority under 35 U.S.C. § 119 on Patent Application No. 2015-126655 filed in Japan on Jun. 24, 2015 and Patent Application No. 2016-111192 filed in Japan on Jun. 2, 2016, the entire contents of both of which are hereby incorporated by reference.

TECHNICAL FIELD

The present invention relates to a directional coupler including two rectangular waveguides. Furthermore, the present invention relates to a diplexer including such a directional coupler.

BACKGROUND ART

In the technical field dealing with high-frequency signals such as microwaves and millimeter waves, a directional coupler which divides such a high-frequency signal or combines such high-frequency signals is widely used. As an example of such a directional coupler, FIG. 1 of Non-patent Literature 1 illustrates a directional coupler including two post-wall waveguides sharing a waveguide narrow wall having an opening. FIG. 29 is a perspective view schematically illustrating a configuration of a directional coupler 7 disclosed in Non-patent Literature 1. FIG. 29 schematically illustrates post walls for a representation as conductor walls. More specifically, FIG. 29 schematically illustrates post-wall waveguides each including a pair of conductor plates provided on respective both sides of a dielectric substrate and a pair of post walls for a representation of rectangular waveguides each including four conductor walls.

As illustrated in FIG. 29, the directional coupler 7 includes a first rectangular waveguide 71 and a second rectangular waveguide 72. The first rectangular waveguide 71 and the second rectangular waveguide 72 share a narrow wall 73. The narrow wall 73 has an opening 731, and an inside of the first rectangular waveguide 71 and an inside of the second rectangular waveguide 72 are communicated with each other via the opening 731.

Provision of the opening 731 in the narrow wall 73 enables the first rectangular waveguide 71 and the second rectangular waveguide 72 to be electromagnetically coupled with each other. Accordingly, for example, in a case where a high-frequency signal is caused to enter a first port P1, the high-frequency signal is caused to exit not only from a second port P2 but also from a third port P3 and a fourth port P4. In this case, a ratio of a power of the high-frequency signal caused to exit from the third port P3 to a power of the high-frequency signal caused to enter the first port P1 depends on a strength of coupling between the first rectangular waveguide 71 and the second rectangular waveguide 72. The strength of coupling is referred to as a coupling degree. The coupling degree can be changed by changing a width W of the opening. In a case of a directional coupler having a coupling degree of 3 dB, a ratio of a power of the high-frequency signal caused to exit from the third port P3 to a power of the high-frequency signal caused to exit from the second port P2 is 1:1.

CITATION LIST

Non Patent Literature

[Non-Patent Literature 1]
Z. C. Hao et al., Microwaves, Antennas and Propagation, IEE Proceedings, Vol. 153, No. 5, p. 426, October 2006
[Non-Patent Literature 2]
Ji-Xin Chen et al., IEEE Microwave and Wireless Components Letters, Vol. 16, No. 2, p. 84, February 2006

SUMMARY OF INVENTION

Technical Problem

The inventors of the present application (hereinafter, inventors) determined parameters of the directional coupler 7 of a first conventional example as follows so that an operation frequency in design was 60 GHz, i.e. 39.5 GHz which is approximately ⅔ of 60 GHz is a cutoff frequency in a $TE_{10}$ mode.

A specific inductive capacity of the inside of the first rectangular waveguide 71 and a specific inductive capacity of the inside of the second rectangular waveguide 72 were each set to 3.823.

A width of the first rectangular waveguide 71 and a width of the second rectangular waveguide 72 were each set to 1.94 mm.

A height of the first rectangular waveguide 71 and a height of the second rectangular waveguide 72 were each set to 0.5 mm.

A thickness of the narrow wall 73 was set to 0.2 mm.

In order that the directional coupler had a coupling degree of approximately 3 dB, the width W of the opening 731 was set to 2.85 mm.

FIG. 30 shows a result of calculating a frequency dependency of S parameters with use of the conventional directional coupler 7 whose parameters were set as above (hereinafter, first conventional example). Among S parameters shown in FIG. 30, S(1,1) indicates a ratio of, in a case where a high-frequency signal was caused to enter the first port P1, a power of a high-frequency signal reflected from the first port P1 to a power of the high-frequency signal caused to enter the first port P1. Similarly, S(1,2), S(1,3), and S(1,4) indicate respective ratios of, in a case where a high-frequency signal was caused to enter the first port P1, powers of high-frequency signals caused to exit from the second port P2, the third port P3, and the fourth port P4 to a power of the high-frequency signal caused to enter the first port P1.

In a frequency domain of 50 GHz to 59 GHz, S(1,1) and S(1,4) are each lower than −13 dB, showing that the coupling between the first rectangular waveguide 71 and the second rectangular waveguide 72 realizes an overcoupling characteristic. This indicates that in the frequency domain of not less than 50 GHz and not more than 59 GHz, the directional coupler 7 of the first conventional example operates as a directional coupler.

On the other hand, it is found that in a frequency domain of more than 60 GHz which is an operation frequency set at the time of the design (frequency domain of not less than 60 GHz and not more than 70 GHz), S(1,1) and S(1,4) increase. Specifically, S(1,1) and S(1,4) are higher than −13 dB at approximately 60.5 GHz and reach approximately −6.5 dB at 62 GHz. In a case where a high-frequency signal is caused to enter the first port P1, emission of a high-frequency signal from the fourth port P4 indicates a decrease in directivity of the directional coupler 7. In a case where a high-frequency signal is caused to enter the first port P1, reflection of a high-frequency signal from the first port P1 indicates breakdown of consistency of the directional coupler 7. As above, it is found that the directional coupler 7 does not operate properly as a directional coupler.

In order to detect the cause, the inventors calculated an electric field strength at a plane parallel to a wide wall of the directional coupler 7 of the first conventional example. The result of calculation of the electric field strength is shown in FIG. 31. (a) of FIG. 31 and (b) of FIG. 31 are contour views showing electric field strengths in cases where high-frequency signals of 55 GHz and 62 GHz were caused to enter the first port P1, respectively.

Three points are found from (a) of FIG. 31: (1) a high-frequency signal caused to enter the first port P1 was propagated inside the first waveguide 71 and was caused to exit from the second port P2; (2) a high-frequency signal coupled from the inside of the first waveguide 71 to the inside of the second waveguide 72 via the opening 731 was caused to exit from the third port P3; and (3) a high-frequency signal which was coupled from the inside of the first waveguide 71 to the inside of the second waveguide 72 via the opening 731 and which was caused to exit from the fourth port P4 had an electric field strength clearly smaller than that of the high-frequency signal caused to exit from the third port P3.

It is found from (b) of FIG. 31 that (1) a state of an electric field strength distributed for the first waveguide 71 and the second waveguide 72 via the opening 731 was off-balanced, and consequently (2) a high-frequency signal caused to enter the first port P was caused to exit not only from the second port P2 and the third port P3 but also from the fourth port P4 with a large electric field strength.

FIG. 2 of Non-Patent Literature 2 illustrates, as a technique for producing a high-performance mixer, a developed form of the directional coupler 7 described above which developed form is inexpensive and not bulky. FIG. 32 is a perspective view schematically illustrating a configuration of a directional coupler 8 disclosed in Non-Patent Literature 2. As with FIG. 29, FIG. 32 schematically illustrates post walls for a representation as conductor walls. FIG. 32 schematically illustrates post-wall waveguides each including a pair of conductor plates provided on respective both sides of a dielectric substrate and a pair of post walls for a representation of rectangular waveguides each including four conductor walls.

The directional coupler 8 includes two rectangular waveguides 81 and 82 sharing a first narrow wall 83 having an opening 831. The two rectangular waveguides 81 and 82 have respective protruding parts 81*b* and 82*b* each protruding from a second narrow wall toward the first narrow wall 83. Stated differently, the first rectangular waveguide 81 has a width at the protruding part 81*b* which width is smaller by a protrusion amount P than a width of the first rectangular waveguide 81 at a first part 81*a* and a width of the first rectangular waveguide 81 at a second part 81*c*. This applies similarly to a width of the second rectangular waveguide 82 at the protruding part 82*b*. The directional coupler 8 is configured such that a length L of each of the protruding parts 81*b* and 82*b* is smaller than a width W of the opening 831.

The inventors determined parameters of the directional coupler 8 of a second conventional example as follows so that an operation frequency was 60 GHz, i.e. 39.5 GHz which is approximately ⅔ of 60 GHz is a cutoff frequency in a $TE_{10}$ mode.

A specific inductive capacity of the inside of the first rectangular waveguide 81 and a specific inductive capacity of the inside of the second rectangular waveguide 82 were each set to 3.823.

A width of the first rectangular waveguide 81 and a width of the second rectangular waveguide 82 were each set to 1.94 mm.

A height of the first rectangular waveguide 81 and a height of the second rectangular waveguide 82 were each set to 0.5 mm.

A thickness of the narrow wall 83 was set to 0.2 mm.

In order that the directional coupler had a coupling degree of approximately 3 dB, the width W of the opening 831 was set to 2.85 mm.

Respective protrusion amounts P of the protruding parts 81*b* and 82*b* were each set to 300 μm.

Respective lengths L of the protruding parts 81*b* and 82*b* were each set to 2.4 mm, 2.85 mm, and 3.2 mm. The description below refers to (i) a directional coupler 8 having a length L of 2.4 mm as a directional coupler 8 of the second conventional example, (ii) a directional coupler 8 having a length L of 2.85 mm as a directional coupler 8 of a third conventional example, and (iii) a directional coupler 8 having a length L of 3.2 mm as a directional coupler 8 of a fourth conventional example.

FIGS. 33 through 35 show results of calculating frequency dependencies of S parameters with use of the respective directional couplers 8 of the second to fourth conventional examples.

With reference to FIG. 33, it is found that in a wide frequency domain centered at 60 GHz, S(1,1) and S(1,4) of the directional coupler 8 of the second conventional example are each not less than −13 dB, that is, a return loss increases and directivity decreases.

With reference to FIG. 34, it is found that in a wide frequency domain centered at 60 GHz, S(1,1) and S(1,4) of the directional coupler 8 of the third conventional example are each not less than −13 dB, that is, a return loss increases and directivity decreases.

With reference to FIG. 35, it is found that in a wide frequency domain centered at 60 GHz, S(1,1) and S(1,4) of the directional coupler 8 of the fourth conventional example are each not less than −13 dB, that is, a return loss increases and directivity decreases.

As above, it is found that even in a case where the first rectangular waveguide 81 and the second rectangular waveguide 82 both have respective protruding part 81*b* and protruding part 82*b*, it is impossible to reduce a return loss at an operation frequency set at the time of the design.

The present invention was made in view of the foregoing problem. An object of the present invention is to provide a directional coupler which can be used for microwaves and millimeter waves and which can reduce a return loss at an operation frequency set at the time of the design.

Solution to Problem

In order to solve the above problem, a directional coupler in accordance with the present invention is a directional coupler, including: a first rectangular waveguide and a second rectangular waveguide sharing a first narrow wall having an opening, the first rectangular waveguide and the second rectangular waveguide each including a second narrow wall and having a width varying part resulting from the second narrow wall having a protruding part, the protruding part protruding toward the first narrow wall, the width varying part including at least a portion of the opening, the protruding part of the second narrow wall protruding toward the first narrow wall by a protrusion amount larger at a center of the width varying part than at both ends of the width varying part.

Advantageous Effects of Invention

The present invention makes it possible to provide a directional coupler which can be used for microwaves and millimeter waves and which can reduce a return loss at an operation frequency set at the time of the design.

Figure 28:
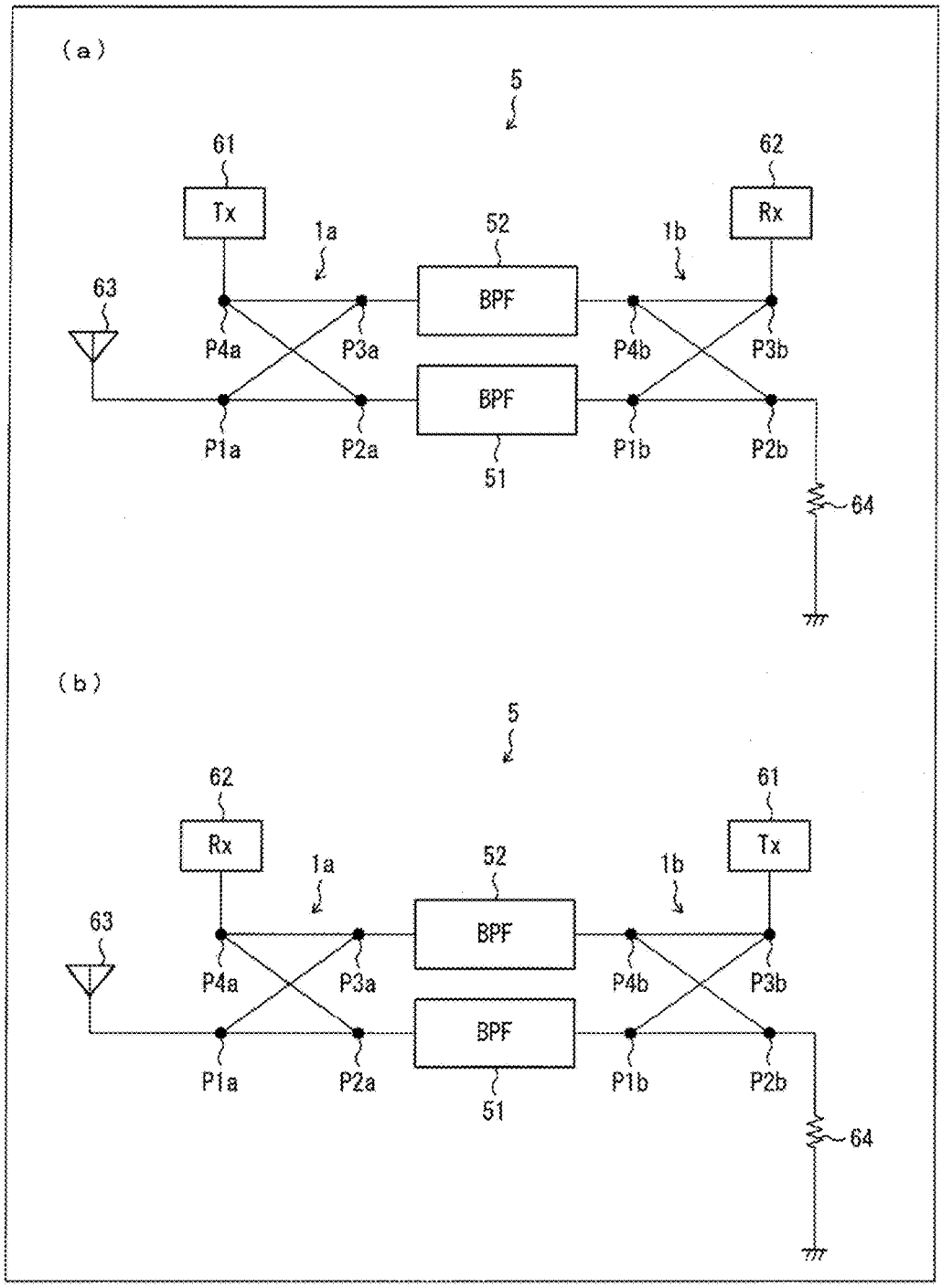

(a) and (b) of FIG. 28 are each a block diagram illustrating a configuration of a diplexer in accordance with Embodiment 3 of the present invention.

Figure 29:
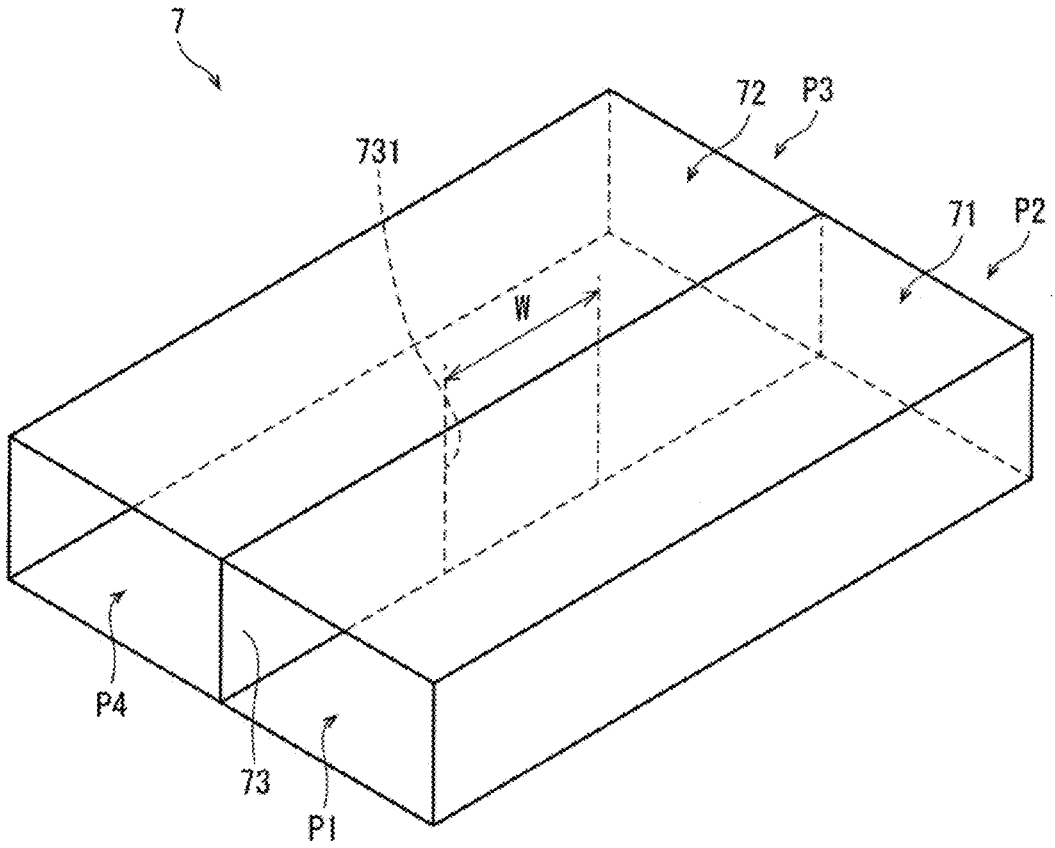

FIG. 29 is a perspective view illustrating a configuration of a directional coupler in accordance with Non-Patent Literature 1.

Figure 30:
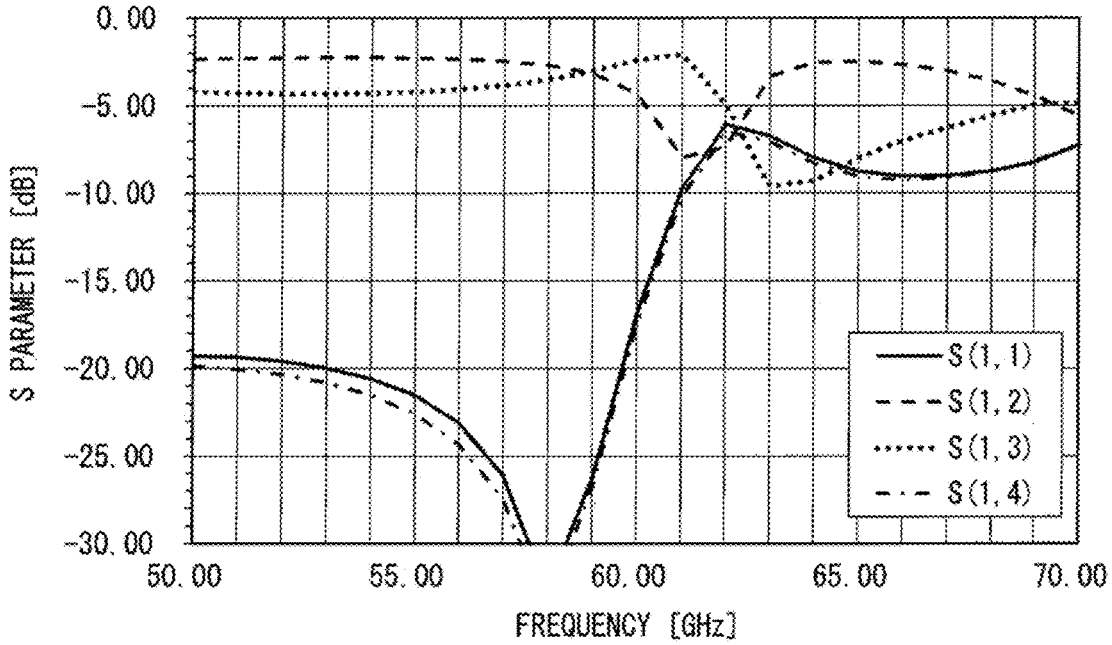

FIG. 30 is a graph illustrating a frequency dependency of S parameters of the directional coupler.

Figure 31:
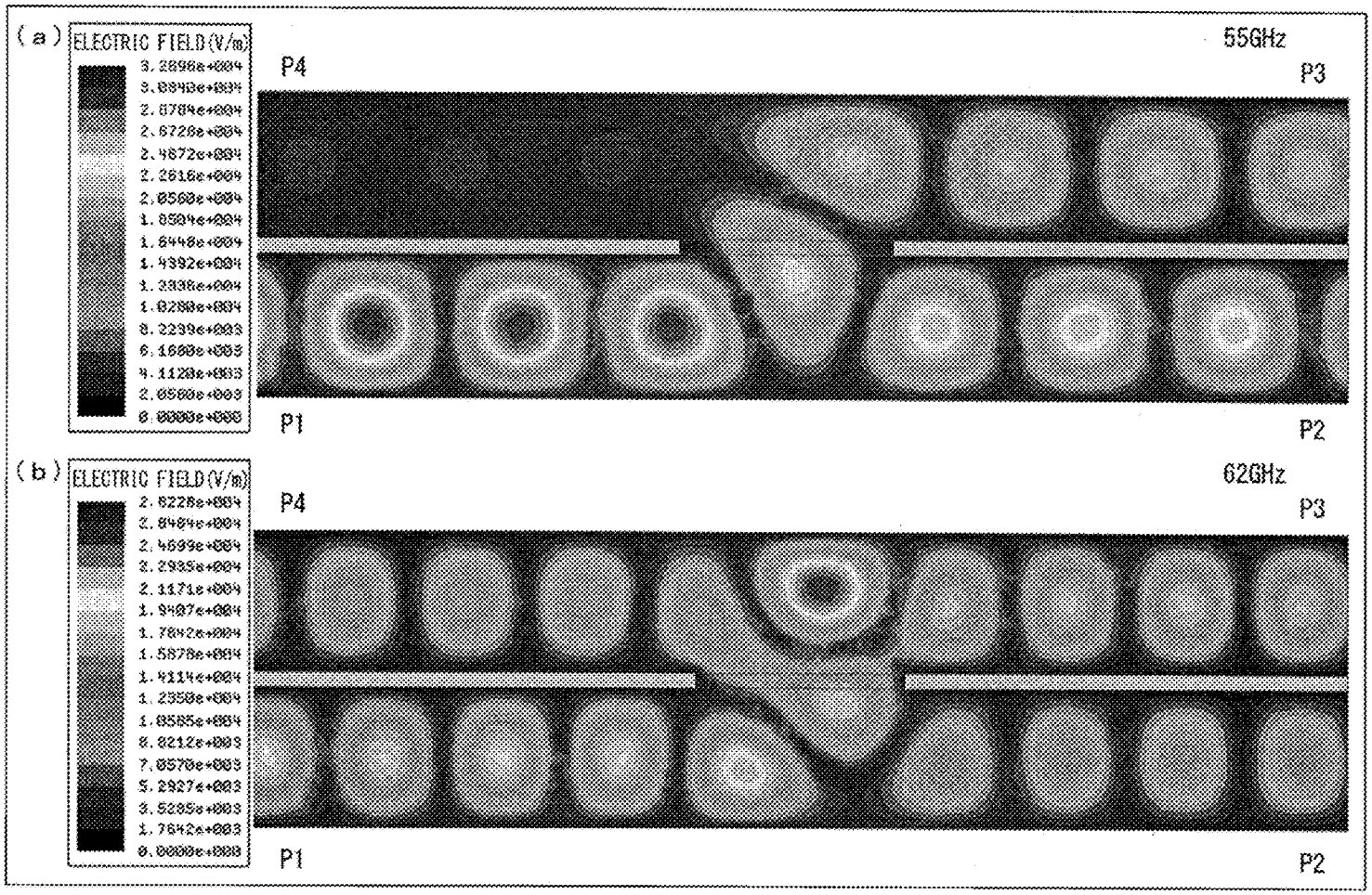

FIG. 31 provides contour views showing electric field strengths at an H plane of the directional coupler.

Figure 32:
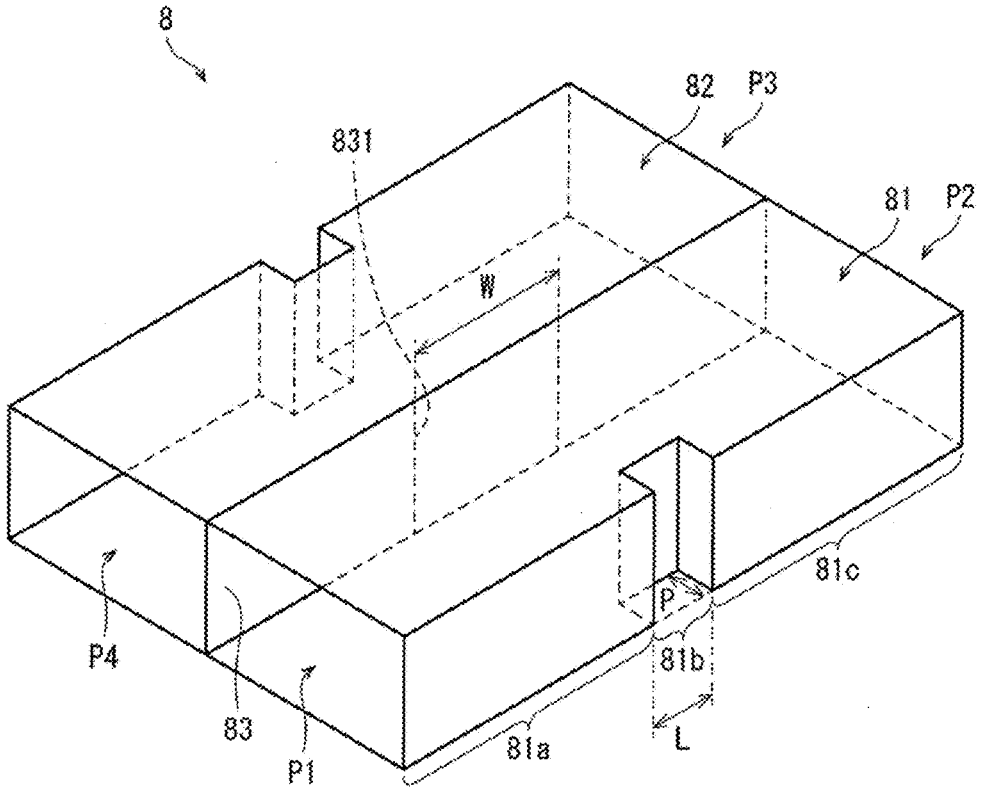

FIG. 32 is a perspective view illustrating a configuration of a directional coupler in accordance with Non-Patent Literature 2.

Figure 33:
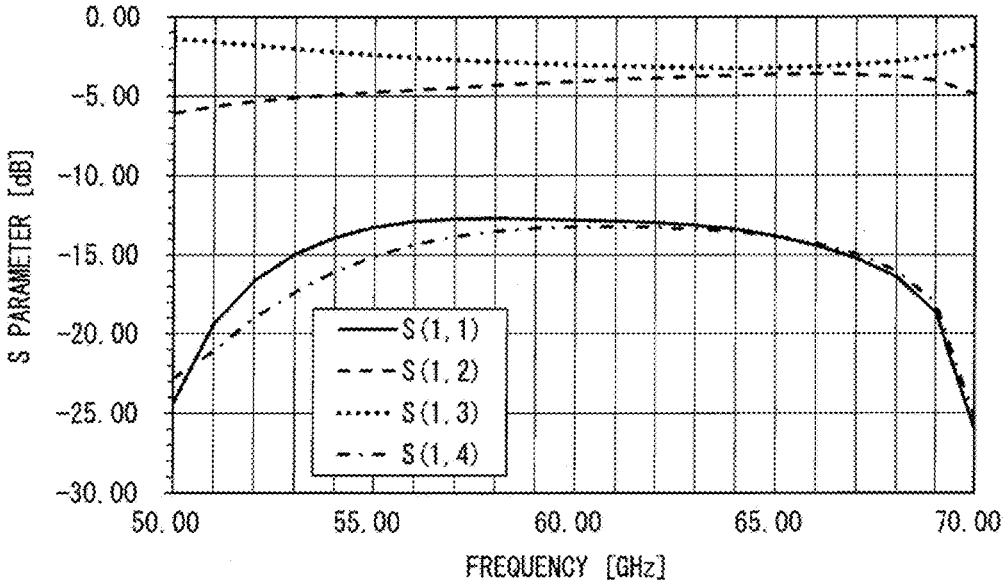

FIG. 33 is a graph illustrating a frequency dependency of S parameters of the directional coupler.

Figure 34:
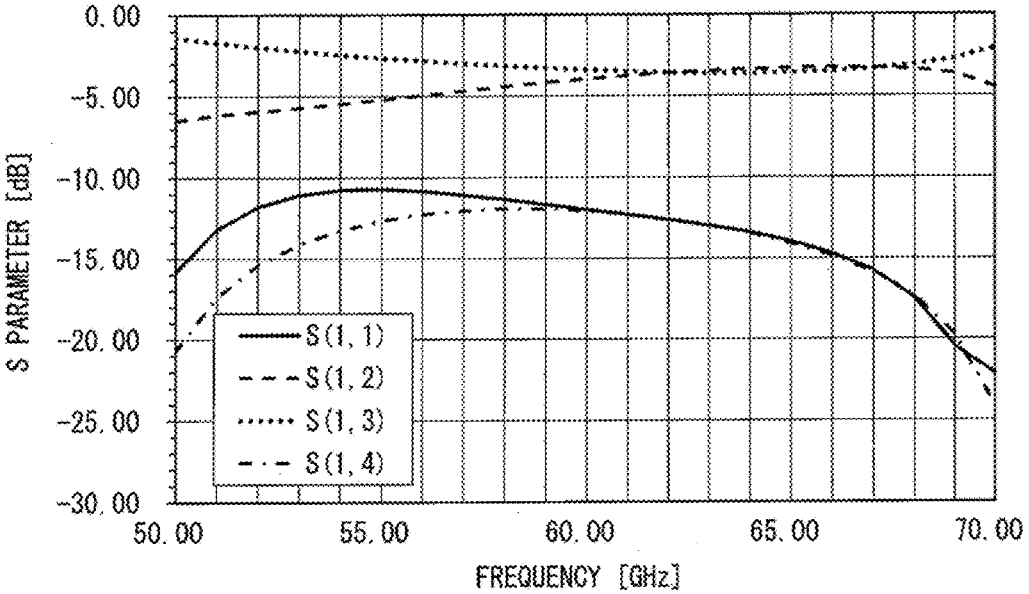

FIG. 34 is a graph illustrating a frequency dependence of S parameters of a variation of the directional coupler in accordance with Non-Patent Literature 2.

Figure 35:
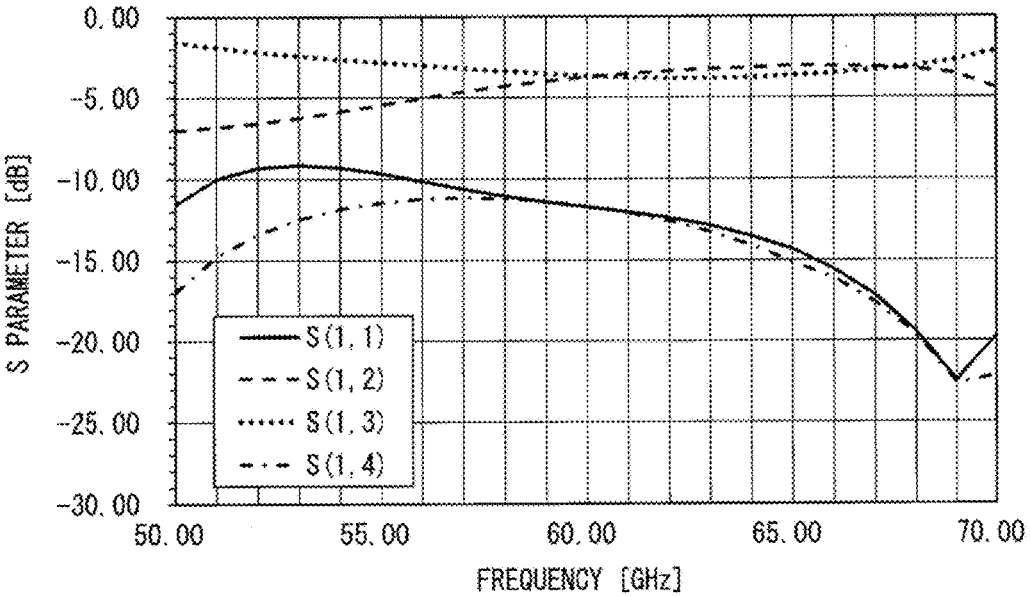

FIG. 35 is a graph illustrating a frequency dependence of S parameters of another variation of the directional coupler in accordance with Non-Patent Literature 2.

DESCRIPTION OF EMBODIMENTS

Embodiment 1

Figure 1:
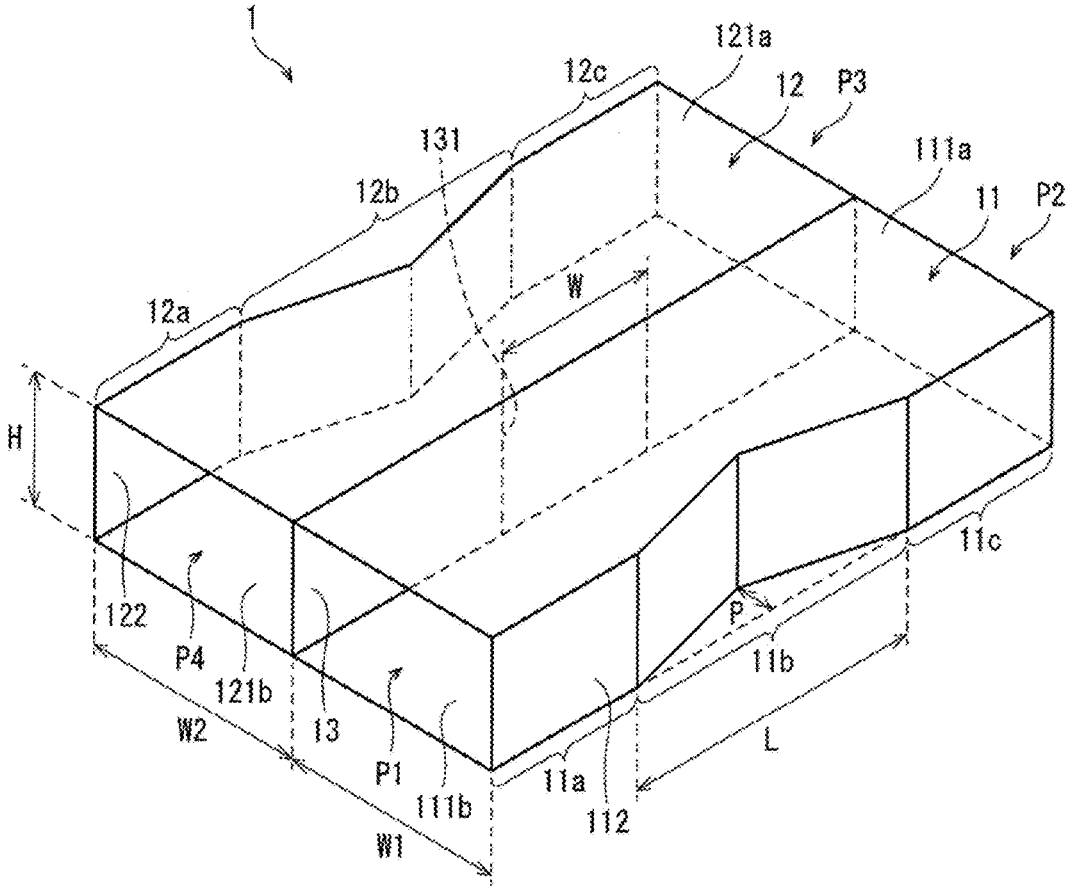
FIG. 1 is a perspective view illustrating a configuration of a directional coupler in accordance with Embodiment 1 of the present invention.

With reference to FIG. 1, the following description will discuss a directional coupler in accordance with Embodiment 1 of the present invention. FIG. 1 is a perspective view illustrating a configuration of a directional coupler 1 in accordance with Embodiment 1.

As illustrated in FIG. 1, the directional coupler 1 includes a first waveguide 11 and a second waveguide 12. The first waveguide 11 and the second waveguide 12 have respective identical heights H. The first waveguide 11 is a rectangular waveguide and has a width W1 which is longer than the height H. Similarly, the second waveguide 12 is a rectangular waveguide and has a width W2 which is longer than the height H. The first waveguide 11 and the second waveguide 12 share a narrow wall 13 which is a first narrow wall out of a pair of narrow walls constituting each of the first waveguide 11 and the second waveguide 12.

The first waveguide 11 is a tubular waveguide and includes the narrow wall 13, a narrow wall 112 which is a second narrow wall facing the narrow wall 13, and a pair of wide wall 111*a* and wide wall 111*b*. Similarly, the second waveguide 12 is a tubular waveguide and includes the narrow wall 13, a narrow wall 122 which is a second narrow wall facing the narrow wall 13, and a pair of wide wall 121*a* and wide wall 121*b*.

The narrow wall 13 has an opening 131. An inside of the first waveguide 11 and an inside of the second waveguide 12 are communicated with each other via the opening 131. The opening 131 has a height H identical to the respective heights H of the first waveguide 11 and the second waveguide 12. The first waveguide 11 and the second waveguide 12 are coupled with each other via the opening 131. Therefore, the directional coupler 1 is a directional coupler using an H-plane coupling.

By changing a width W of the opening 131, it is possible to change a degree of coupling between the first waveguide 11 and the second waveguide 12 of the directional coupler 1 (hereinafter, referred to as a coupling degree of the directional coupler 1). That is, the width W is an important parameter which controls the coupling degree of the directional coupler 1.

Hereinafter, the directional coupler 1 whose coupling degree is, for example, 3 dB will be referred to as a directional coupler having a coupling degree of 3 dB.

The first waveguide 11 includes a protruding part 11*b* which (i) is a part of the narrow wall 112 facing the opening 131, (ii) is provided between a first part 11*a* having a uniform width W1 and a second part 11*c* having a uniform width W1, and (iii) protrudes toward the opening 131. A protrusion amount P by which the protruding part 11*b* of the narrow wall 112 protrudes toward the narrow wall 13 is larger at a center of the protruding part 11*b* than at both ends of the protruding part 11*b* (a part where the protruding part 11*b* is connected with the first part 11*a* and a part where the protruding part 11*b* is connected with the second part 11*c*). That is, the protrusion amount P at the center of the protruding part 11*b* is larger than the protrusion amount P at the both ends of the protruding part 11*b*, and the width W1 at the center of the protruding part 11*b* is smaller than the width W1 at the both ends of the protruding part 11*b*. As a result of the narrow wall 112 having the protruding part 11*b*, the first waveguide 11 has a width varying part, which is smaller in width than other parts. This applies also to any other first waveguide described later.

Similarly, the second waveguide 12 includes a protruding part 12*b* which (i) is a part of the narrow wall 122 facing the opening 131, (ii) is provided between a first part 12*a* having a uniform width W2 and a second part 12*c* having a uniform width W2, and (iii) protrudes toward the opening 131. A protrusion amount P by which the protruding part 12*b* of the narrow wall 122 protrudes toward the narrow wall 13 is larger at a center of the protruding part 12*b* than at both ends of the protruding part 12*b* (a part where the protruding part 12*b* is connected with the first part 12*a* and a part where the protruding part 12*b* is connected with the second part 12*c*). That is, the protrusion amount P at the center of the protruding part 12*b* is larger than the protrusion amount P at the both ends of the protruding part 12*b*, and the width W2 at the center of the protruding part 12*b* is smaller than the width W2 at the both ends of the protruding part 12*b*. As a result of the narrow wall 122 having the protruding part 12*b*, the second waveguide 12 has a width varying part, which is smaller in width than other parts. This applies also to any other second waveguide described later.

(Classification of Directional Couplers)

A directional coupler is classified here depending on how a protrusion amount P changes in a protruding part.

Hereinafter, a directional coupler, configured such that a protrusion amount P becomes larger as farther from both ends of a protruding part and closer to a center of the protruding part, is referred to as a directional coupler of a taper type. Depending on how the protrusion amount P changes, the directional coupler of the taper type is classified into a slope taper type and a step taper type.

The directional coupler of the slope taper type indicates a directional coupler including a protruding part configured such that a protrusion amount P becomes continuously larger as farther from both ends of the protruding part and closer to a center of the protruding part. Specific examples of the protrusion amount P which becomes continuously larger encompass a protrusion amount P represented by a linear function or quadric as a function of a distance from both ends of a protruding part. Furthermore, examples of the directional coupler 1 of the slope taper type encompass a directional coupler in which, in a case where a wide wall is seen from above, a narrow wall of a protruding part is configured to have a part of an arc of a circle or of an ellipse.

At each of the protruding parts 11*b* and 12*b* of the directional coupler 1 illustrated in FIG. 1, the protrusion amount P is represented by a linear function, i.e., a function of a distance from the both ends of the each of the protruding parts 11*b* and 12*b*. Accordingly, the directional coupler 1 is a specific example of the directional coupler of the slope taper type.

The directional coupler of the step taper type indicates a directional coupler configured such that a protrusion amount P becomes discretely larger as farther from both ends of a protruding part and closer to a center of the protruding part. In other words, the directional coupler of the step taper type is a directional coupler configured such that a protrusion amount P becomes larger a plurality of times, i.e., becomes larger stepwise as farther from both ends of a protruding part and closer to a center of the protruding part.

A directional coupler 2 described later in Embodiment 2 (see FIG. 11) is a specific example of the directional coupler of the step taper type.

Furthermore, a directional coupler, configured such that a protrusion amount P is uniform across a protruding part, is hereinafter referred to as a directional coupler of a step type. A directional coupler 3 described later in the reference embodiment (see FIG. 17) and the directional coupler 8 described in Non-Patent Literature 2 (see FIG. 32) are each a specific example of the directional coupler of the step type.

(Relation in Size Between Length L of Protruding Part and Width W of Opening)

In the directional coupler 1 in accordance with Embodiment 1, a relation in size between (i) a length L of each of the protruding parts 11*b* and 12*b* and (ii) the width W of the opening 131 is not particularly limited. That is, the relation in size between the length L and the width W can be any one of L>W, L=W, and L<W. The directional coupler 1, illustrated in FIG. 1, employs L>W as the relation in size between the length L and the width W.

Note that influence given to a transmission characteristic of the directional coupler 1 by a change in relation in size between the length L and the width W will be described later with reference to FIG. 2 and FIGS. 4 through 9.

(Configuration of Directional Coupler)

The directional coupler 1 can employ, as each of the first waveguide 11 and the second waveguide 12, a post-wall waveguide or a metal waveguide tube. The post-wall waveguide is a waveguide which is surrounded on all four sides by (i) a pair of conductor plates provided on respective both sides of a dielectric substrate and (ii) a pair of post walls. The pair of post walls penetrate the dielectric substrate so as to cause the pair of conductor plates to be electrically conductive. Conductor posts are each made of (i) a conductor provided along an inner wall of a through-hole penetrating the dielectric substrate or (ii) a conductor filling the through-hole. A configuration, in which the post-wall waveguide is employed as each of the first waveguide 11 and the second waveguide 12, will be later described with reference to FIG. 27.

Note that, in a case where a metal waveguide tube is employed as each of the first waveguide 11 and the second waveguide 12, the metal waveguide tube serving as the each of the first waveguide 11 and the second waveguide 12 can be filled with a dielectric material having a desired specific inductive capacity, so as to control (i) a specific inductive capacity of an inside of the first waveguide 11 and (ii) a specific inductive capacity of an inside of the second waveguide 12. On the other hand, in the case where the post-wall waveguide is employed as each of the first waveguide 11 and the second waveguide 12, it is possible to control (i) the specific inductive capacity of the inside of the first waveguide 11 and (ii) a specific inductive capacity of a medium of the second waveguide 12 by selecting a dielectric substrate having a desired specific inductive capacity for each of the first waveguide 11 and the second waveguide 12.

(Function of Directional Coupler)

In a case where a high-frequency signal is caused to enter a first port P1 of the directional coupler 1, the high-frequency signal is propagated inside the first waveguide 11 and is then caused to exit from a second port P2. Furthermore, the high-frequency signal coupled to the second waveguide 12 via the opening 131 is propagated inside the second waveguide 12 and is caused to exit from a third port P3. The directional coupler 1 thus functions as a divider which receives a high-frequency signal via one port and causes the high-frequency signal to exit via two ports.

Note that the high-frequency signal, which was caused exit from the second port P2, has a phase identical to that of the high-frequency signal which was caused to enter the first port P1. In contrast, the high-frequency signal, which was caused to exit from the third port P3, has a phase shifted by 90° from that of the high-frequency signal which was caused to enter the first port P1. That is, the phase of the high-frequency signal which is caused to exit from the second port P2 is shifted by 90° from the phase of the high-frequency signal which is caused to exit from the third port P3. For this reason, the directional coupler 1 is also referred to as a 90° hybrid.

In a case where (i) a first high-frequency signal is caused to enter the second port P2 and (ii) a second high-frequency signal whose phase is shifted by 90° from that of the first high-frequency signal is caused to enter the third port P3, a high-frequency signal, which is caused by superimposing the first high-frequency signal on the second high-frequency signal, is caused to exit from the first port P1. Thus, the directional coupler 1 also functions as a superimposing unit which receives high-frequency signals via respective two ports and then causes one high-frequency signal to exit via one port.

Example 1

Figure 2:
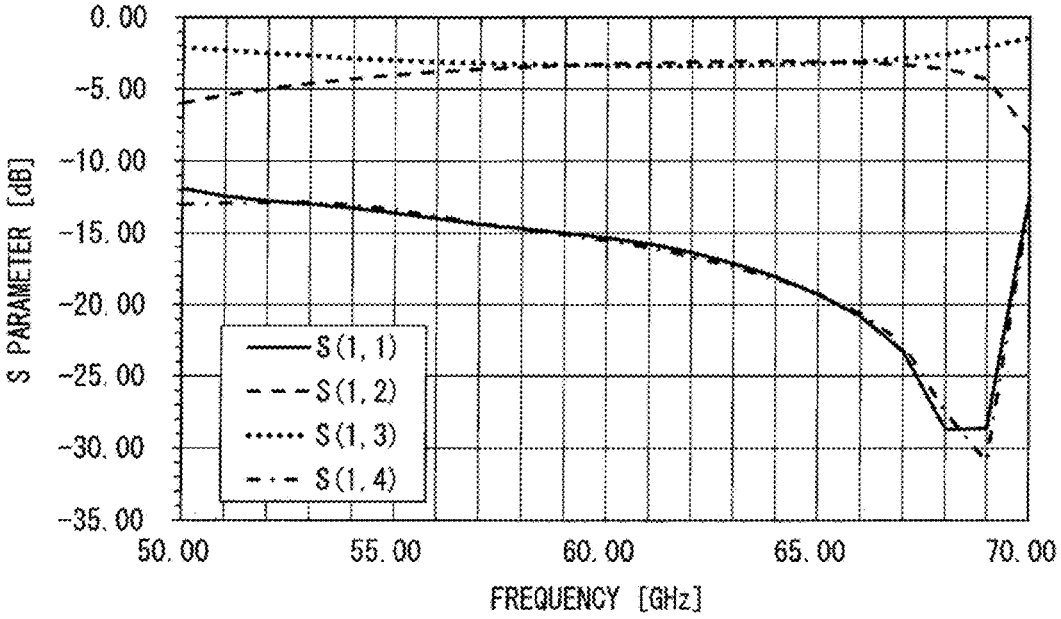
FIG. 2 is a graph illustrating a frequency dependency of S parameters of a directional coupler in accordance with Example 1 of the present invention.
Figure 3:
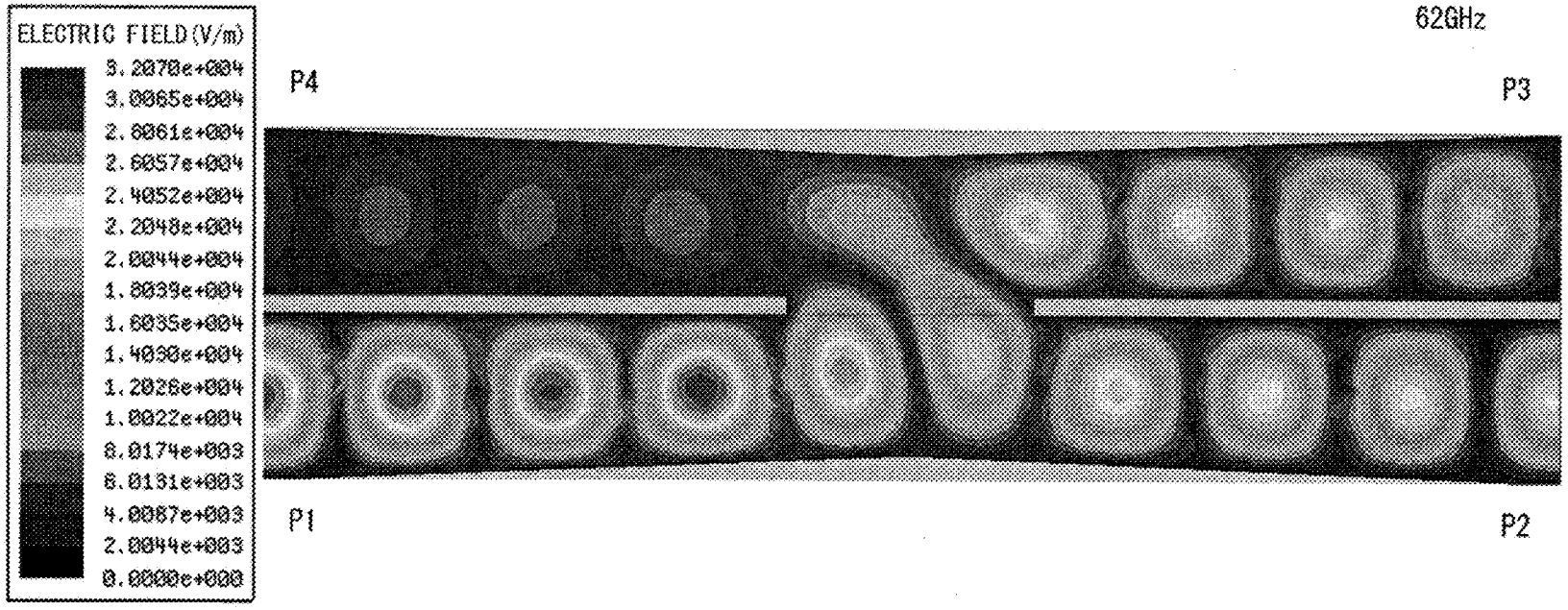
FIG. 3 is a counter view illustrating an electric field strength on an H plane of the directional coupler.

With reference to FIGS. 2 and 3, the following description will discuss a directional coupler in accordance with Example 1 of the present invention. A directional coupler 1 in accordance with Example 1 is obtained by setting parameters of the directional coupler 1 in accordance with Embodiment 1 as follows.

A width W1 and a width W2 were each set to 1.94 mm.

A height H was set to 0.5 mm.

A specific inductive capacity of a dielectric material with which each of waveguides 11 and 12 was filled was set to 3.823.

A width W was set to 2.85 mm.

A length L was set to 15 mm.

A protrusion amount P was set to 300 μm.

An operation frequency set at the time of design of the directional coupler 1 in accordance with Example 1 was 60 GHz. A high-frequency signal with a frequency of 60 GHz had (i) a wavelength of 5.00 mm in a free space and (ii) a wavelength of 2.56 mm in the dielectric material with a specific inductive capacity of 3.823. The high-frequency signal with a frequency of 60 GHz had a guide wavelength of 3.40 mm in the directional coupler 1 configured as above.

The directional coupler 1 in accordance with Example 1 was designed as a directional coupler having a coupling degree of 3 dB.

FIG. 2 illustrates a result of calculation of a frequency dependency of S parameters with use of the directional coupler 1 in accordance with Example 1. FIG. 2 is a graph illustrating a frequency dependency of S parameters of the directional coupler 1 in accordance with Example 1. S parameters of the directional coupler 1 in accordance with Example 1, S(1,1), S(1,2), S(1,3), and S(1,4), were calculated on an assumption that a high-frequency signal was caused to enter a first port P1. A frequency of the high-frequency signal was varied within a frequency range of not less than 50 GHz and not more than 70 GHz. Conditions for calculating the frequency dependency of these S parameters are the same as those for directional couplers 1 in accordance with respective later-described Variations.

Among the S parameters illustrated in FIG. 2, S(1,1) indicates a ratio of a power of a high-frequency signal reflected from the first port P1 to a power of a high-frequency signal caused to enter the first port P1. Similarly, S(1,2), S(1,3), and S(1,4) indicate respective ratios of powers of high-frequency signals caused to exit from a second port P2, a third port P3, and a fourth port P4 to a power of a high-frequency signal caused to enter the first port P1.

In the present specification, a standard for determining whether a directional coupler operates as a directional coupler is based on whether S(1,1) and S(1,4) are each less than −13 dB at an operation frequency set at the time of design. Furthermore, a standard for determining whether a directional coupler operates more suitably as a directional coupler is based on whether a difference between S(1,2) and S(1,3) is less than 1.0 dB.

As is clear from FIG. 2, S(1,1) and S(1,4) were each less than −13 dB in a frequency domain of not less than 54 GHz and not more than 69 GHz. That is, it is found that the directional coupler 1 in accordance with Example 1 can cut return losses in a frequency domain of not less than 54 GHz and not more than 69 GHz including a frequency of 60 GHz which is an operation frequency set at the time of the design. Furthermore, in a frequency domain of not less than 55 GHz and not more than 67 GHz, a difference between S(1,2) and S(1,3) was less than 1.0 dB. That is, it is found that the directional coupler 1 in accordance with Example 1 operates more suitably, as a directional coupler having a coupling degree of 3 dB, in a frequency domain of not less than 55 GHz and not more than 67 GHz.

FIG. 3 illustrates an electric field strength obtained in a case where a high-frequency signal with a frequency of 62 GHz was caused to enter the first port P1 of the directional coupler 1 in accordance with Example 1. FIG. 3 is a counter view illustrating an electric field strength on an H plane of the directional coupler 1 in accordance with Example 1.

It is found from FIG. 3 that a state of an electric field strength distributed for the waveguides 11 and 12 via an opening 131 was not disturbed.

In contrast, as has been described, in a case of an electric field strength on an H plane of the directional coupler 7, illustrated in (b) of FIG. 31, of the first conventional example, a state of an electric field strength distributed for the waveguides 71 and 72 via the opening 731 was disturbed.

In consideration of those results, the inventors infer that it is highly likely that a higher mode appears in a state where a state of an electric field strength is disturbed. The inventors also infer that there is a close relationship between (i) appearance of the higher mode and (ii) an increase in return loss (respective increases in S(1,1) and S(1,4)). Accordingly, the inventors have found that, in order to provide a directional coupler 1 which operates as a directional coupler at an operation frequency set at the time of design, it is important to design protruding parts 11*b* and 12*b* each having a shape which does not disturb a state of an electric field strength distributed for waveguides 11 and 12 via an opening 131.

[Variation 1]

Figure 4:
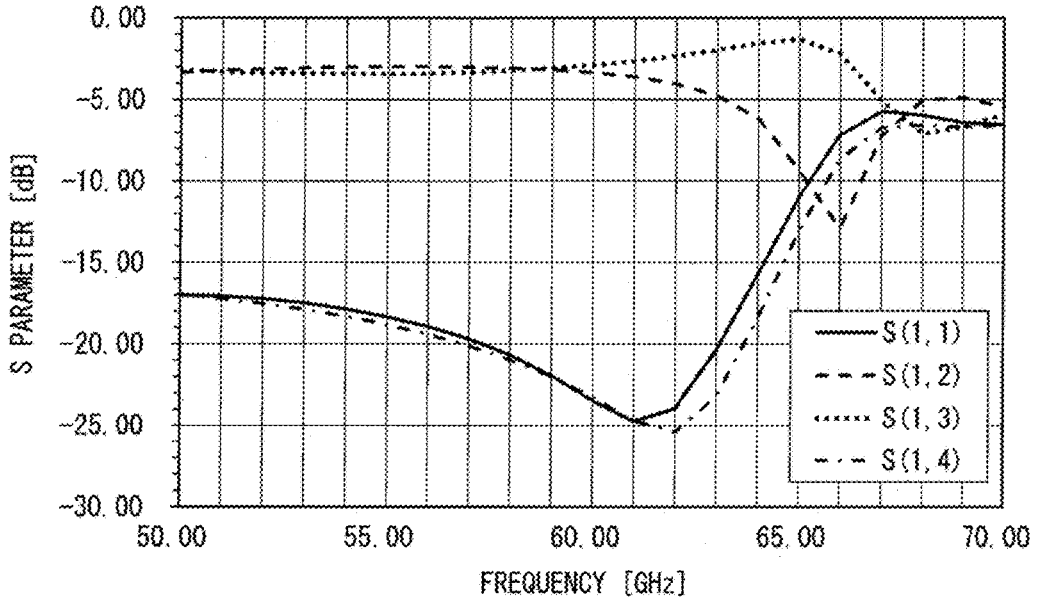
FIG. 4 is a graph illustrating a frequency dependency of S parameters of Variation 1 of the directional coupler.

With reference to FIG. 4, the following description will discuss a directional coupler in accordance with Variation 1 of the present invention. A directional coupler 1 in accordance with Variation 1 is obtained by varying, to 1.2 mm, the length L of each of the protruding parts 11*b* and 12*b* of the directional coupler 1 in accordance with Embodiment 1.

FIG. 4 illustrates a result of calculation of a frequency dependency of S parameters with use of the directional coupler 1 in accordance with Variation 1. FIG. 4 is a graph illustrating a frequency dependency of S parameters of the directional coupler 1 in accordance with Variation 1.

As is clear from FIG. 4, S(1,1) and S(1,4) were each less than −13 dB in a frequency domain of not less than 50 GHz and not more than 64 GHz. That is, it is found that the directional coupler 1 in accordance with Variation 1 can cut return losses in a frequency domain of not less than 50 GHz and not more than 64 GHz including a frequency of 60 GHz which is an operation frequency set at the time of design. Furthermore, in a frequency domain of not less than 51 GHz and not more than 61 GHz, a difference between S(1,2) and S(1,3) was less than 1.0 dB. That is, it is found that the directional coupler 1 in accordance with Variation 1 operates more suitably, as a directional coupler having a coupling degree of 3 dB, in a frequency domain of not less than 51 GHz and not more than 61 GHz.

[Variation 2]

Figure 5:
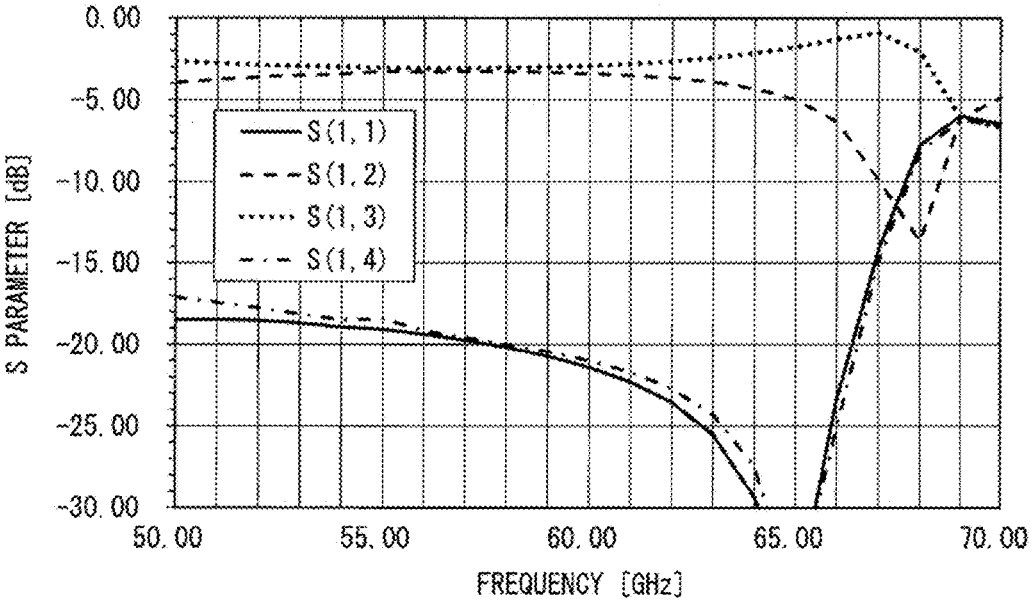
FIG. 5 is a graph illustrating a frequency dependency of S parameters of Variation 2 of the directional coupler.

With reference to FIG. 5, the following description will discuss a directional coupler in accordance with Variation 2 of the present invention. A directional coupler 1 in accordance with Variation 2 is obtained by varying, to 2.4 mm, the length L of each of the protruding parts 11*b* and 12*b* of the directional coupler 1 in accordance with Embodiment 1.

FIG. 5 illustrates a result of calculation of a frequency dependency of S parameters with use of the directional coupler 1 in accordance with Variation 2. FIG. 5 is a graph illustrating a frequency dependency of S parameters of the directional coupler 1 in accordance with Variation 2.

As is clear from FIG. 5, S(1,1) and S(1,4) were each less than −13 dB in a frequency domain of not less than 50 GHz and not more than 67 GHz. That is, it is found that the directional coupler 1 in accordance with Variation 2 can cut return losses in a frequency domain of not less than 50 GHz and not more than 67 GHz including a frequency of 60 GHz which is an operation frequency set at the time of design. Furthermore, in a frequency domain of not less than 51 GHz and not more than 61 GHz, a difference between S(1,2) and S(1,3) was less than 1.0 dB. That is, it is found that the directional coupler 1 in accordance with Variation 2 operates more suitably, as a directional coupler having a coupling degree of 3 dB, in a frequency domain of not less than 51 GHz and not more than 61 GHz.

[Variation 3]

Figure 6:
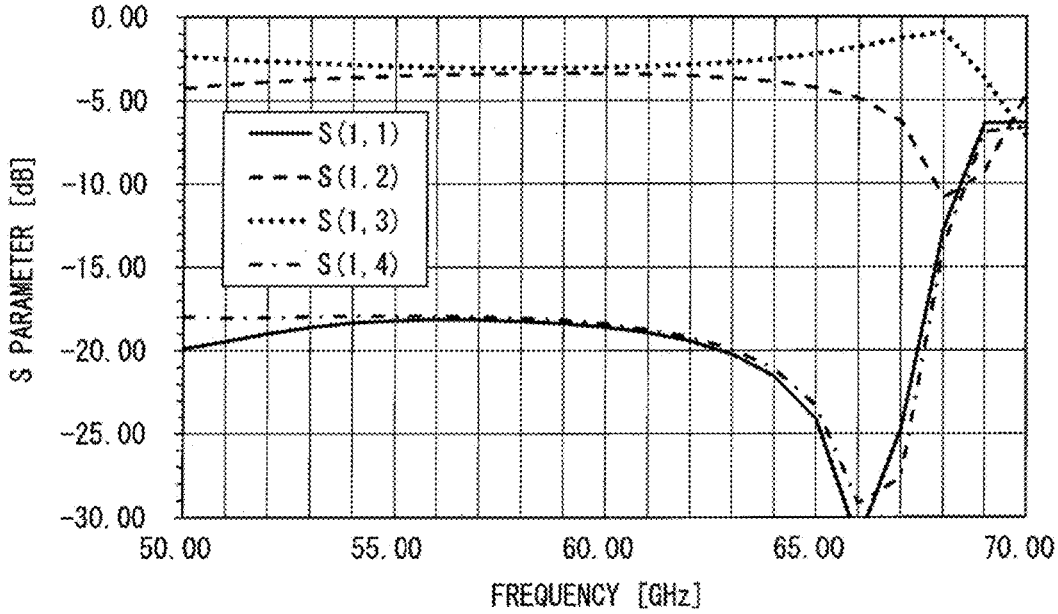
FIG. 6 is a graph illustrating a frequency dependency of S parameters of Variation 3 of the directional coupler.

With reference to FIG. 6, the following description will discuss a directional coupler in accordance with Variation 3 of the present invention. A directional coupler 1 in accordance with Variation 3 is obtained by varying, to 3.2 mm, the length L of each of the protruding parts 11*b* and 12*b* of the directional coupler 1 in accordance with Embodiment 1.

FIG. 6 illustrates a result of calculation of a frequency dependency of S parameters with use of the directional coupler 1 in accordance with Variation 3. FIG. 6 is a graph illustrating a frequency dependency of S parameters of the directional coupler 1 in accordance with Variation 3.

As is clear from FIG. 6, S(1,1) and S(1,4) were each less than −13 dB in a frequency domain of not less than 50 GHz and not more than 67 GHz. That is, it is found that the directional coupler 1 in accordance with Variation 3 can cut return losses in a frequency domain of not less than 50 GHz and not more than 67 GHz including a frequency of 60 GHz which is an operation frequency set at the time of design. Furthermore, in a frequency domain of not less than 53 GHz and not more than 63 GHz, a difference between S(1,2) and S(1,3) was less than 1.0 dB. That is, it is found that the directional coupler 1 in accordance with Variation 3 operates more suitably, as a directional coupler having a coupling degree of 3 dB, in a frequency domain of not less than 53 GHz and not more than 63 GHz.

[Variation 4]

Figure 7:
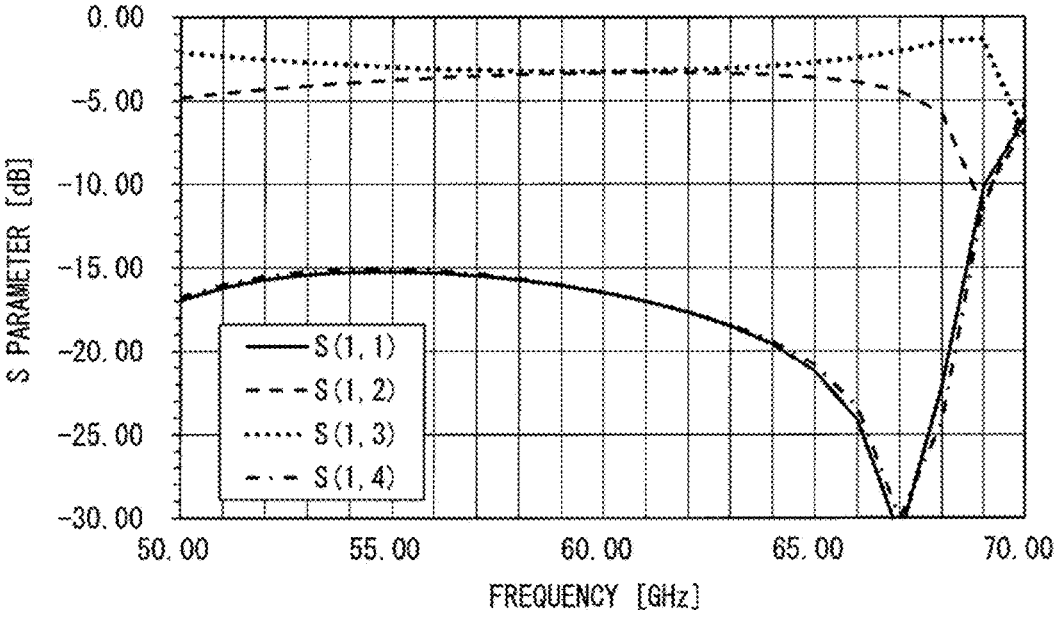
FIG. 7 is a graph illustrating a frequency dependency of S parameters of Variation 4 of the directional coupler.

With reference to FIG. 7, the following description will discuss a directional coupler in accordance with Variation 4 of the present invention. A directional coupler 1 in accordance with Variation 4 is obtained by varying, to 4.8 mm, the length L of each of the protruding parts 11*b* and 12*b* of the directional coupler 1 in accordance with Embodiment 1.

FIG. 7 illustrates a result of calculation of frequency dependency of S parameters with use of the directional coupler 1 in accordance with Variation 4. FIG. 7 is a graph illustrating a frequency dependency of S parameters of the directional coupler 1 in accordance with Variation 4.

As is clear from FIG. 7, S(1,1) and S(1,4) were each less than −13 dB in a frequency domain of not less than 50 GHz and not more than 68 GHz. That is, it is found that the directional coupler 1 in accordance with Variation 4 can cut return losses in a frequency domain of not less than 50 GHz and not more than 68 GHz including a frequency of 60 GHz which is an operation frequency set at the time of design. Furthermore, in a frequency domain of not less than 55 GHz and not more than 65 GHz, a difference between S(1,2) and S(1,3) was less than 1.0 dB. That is, it was found that the directional coupler 1 in accordance with Variation 4 operates more suitably, as a directional coupler having a coupling degree of 3 dB, in a frequency domain of not less than 55 GHz and not more than 65 GHz.

[Variation 5]

Figure 8:
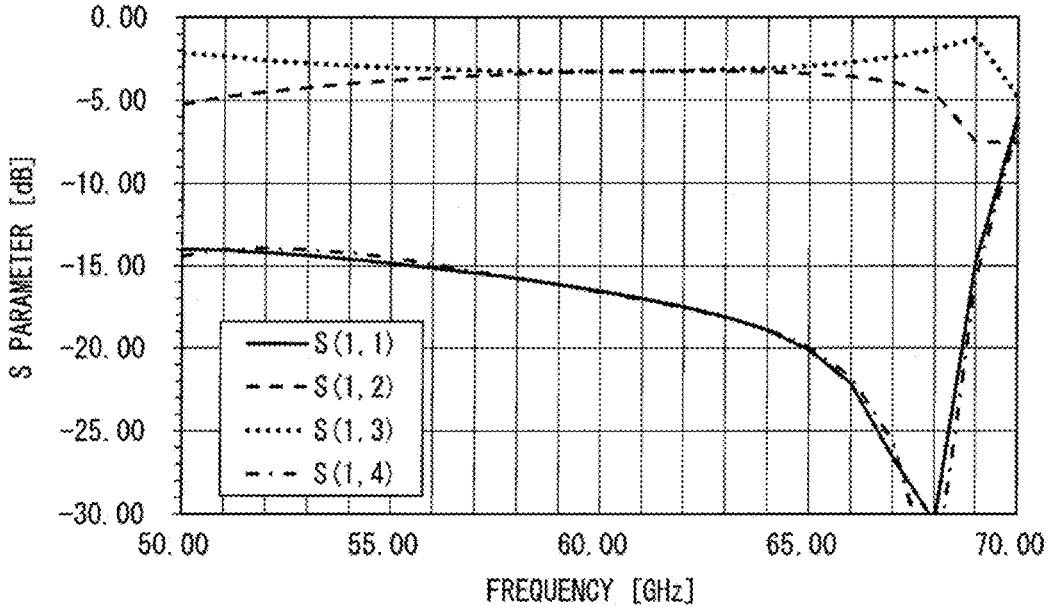
FIG. 8 is a graph illustrating a frequency dependency of S parameters of Variation 5 of the directional coupler.

With reference to FIG. 8, the following description will discuss a directional coupler in accordance with Variation 5 of the present invention. A directional coupler 1 in accordance with Variation 5 is obtained by varying, to 6.4 mm, the length L of each of the protruding parts 11*b* and 12*b* of the directional coupler 1 in accordance with Embodiment 1.

FIG. 8 illustrates a result of calculation of a frequency dependency of S parameters with use of the directional coupler 1 in accordance with Variation 5. FIG. 8 is a graph illustrating a frequency dependency of S parameters of the directional coupler 1 in accordance with Variation 5.

As is clear from FIG. 8, S(1,1) and S(1,4) were each less than −13 dB in a frequency domain of not less than 50 GHz and not more than 69 GHz. That is, it is found that the directional coupler 1 in accordance with Variation 5 can cut return losses in a frequency domain of not less than 50 GHz and not more than 69 GHz including a frequency of 60 GHz which is an operation frequency set at the time of design. Furthermore, in a frequency domain of not less than 55 GHz and not more than 66 GHz, a difference between S(1,2) and S(1,3) was less than 1.0 dB. That is, it is found that the directional coupler 1 in accordance with Variation 5 operates more suitably, as a directional coupler having a coupling degree of 3 dB, in a frequency domain of not less than 55 GHz and not more than 66 GHz.

[Variation 6]

Figure 9:
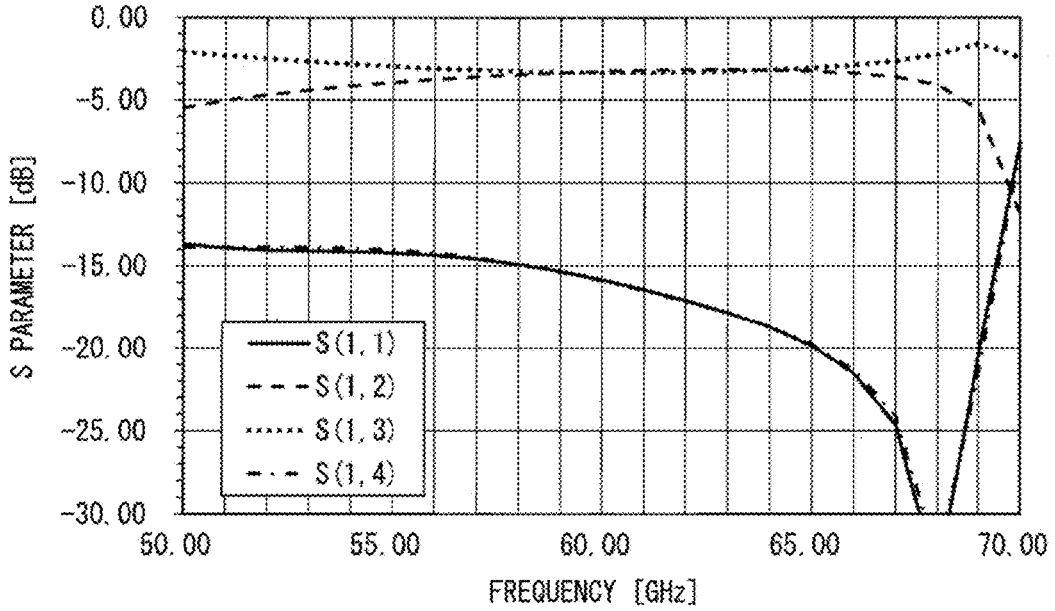
FIG. 9 is a graph illustrating a frequency dependency of S parameters of Variation 6 of the directional coupler.

With reference to FIG. 9, the following description will discuss a directional coupler in accordance with Variation 6 of the present invention. A directional coupler 1 in accordance with Variation 6 is obtained by varying, to 8.8 mm, the length L of each of the protruding parts 11*b* and 12*b* of the directional coupler 1 in accordance with Embodiment 1.

FIG. 9 illustrates a result of calculation of a frequency dependency of S parameters with use of the directional coupler 1 in accordance with Variation 6. FIG. 9 is a graph illustrating a frequency dependency of S parameters of the directional coupler 1 in accordance with Variation 6.

As is clear from FIG. 9, S(1,1) and S(1,4) were each less than −13 dB in a frequency domain of not less than 50 GHz and not more than 69 GHz. That is, it is found that the directional coupler 1 in accordance with Variation 6 can cut return losses in a frequency domain of not less than 50 GHz and not more than 69 GHz including a frequency of 60 GHz which is an operation frequency set at the time of design. Furthermore, in a frequency domain of not less than 55 GHz and not more than 67 GHz, a difference between S(1,2) and S(1,3) was less than 1.0 dB. That is, it is found that the directional coupler 1 in accordance with Variation 6 operates more suitably, as a directional coupler having a coupling degree of 3 dB, in a frequency domain of not less than 55 GHz and not more than 67 GHz.

[Variation 7]

Figure 10:
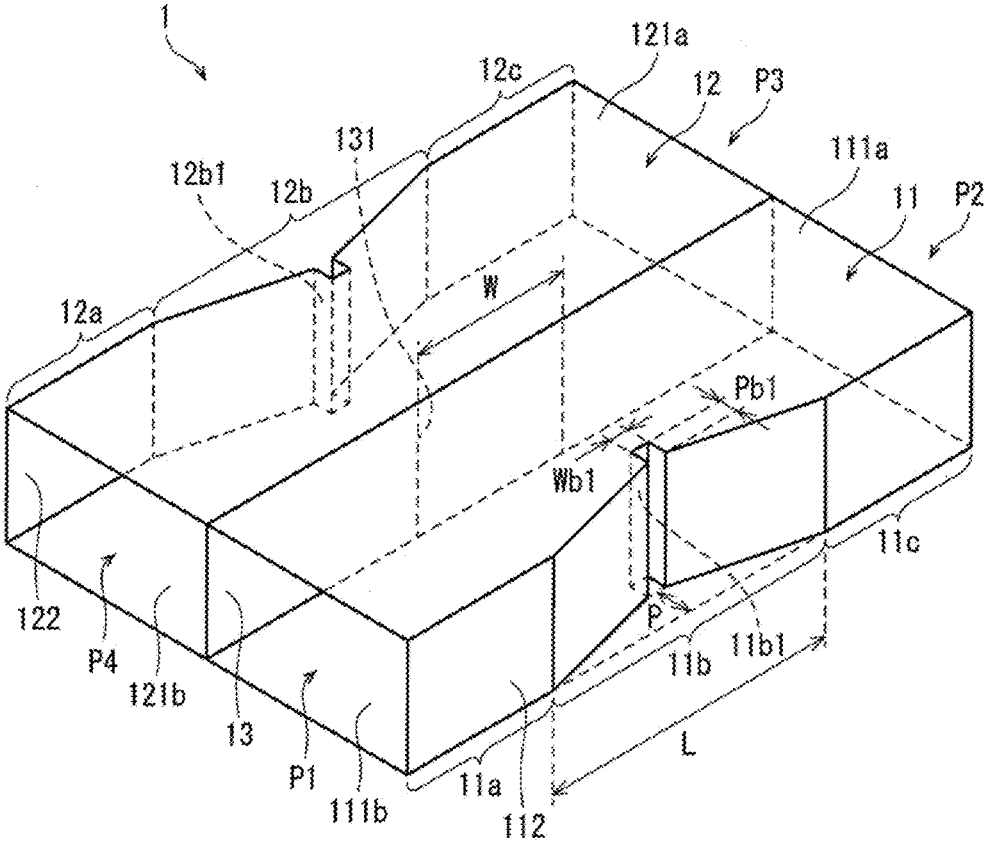
FIG. 10 is a perspective view illustrating a configuration of Variation 7 of the directional coupler.

With reference to FIG. 10, the following description will discuss a directional coupler in accordance with Variation 7 of the present invention. A directional coupler 1 in accordance with Variation 7 is obtained by adding protruding sections 11*b*1 and 12*b*1 to the directional coupler 1 in accordance with Embodiment 1. Therefore, the protruding sections 11*b*1 and 12*b*1 will be described here, and members having configurations similar to those of the members of the directional coupler 1 in accordance with Embodiment 1 will not be described here.

As illustrated in FIG. 10, the protruding sections 11*b*1 and 12*b*1 are provided at respective centers of protruding parts 11*b* and 12*b*, and protrude from respective second narrow walls 112 and 122 toward an opening 131. The protruding section 11*b*1 constitutes a part of the protruding part 11*b*. The protruding section 12*b*1 constitutes a part of the protruding part 12*b*.

A protrusion amount P of the protruding part 11*b* thus configured is larger at the center of the protruding part 11*b* than at both ends of the protruding part 11*b*. Specifically, the protrusion amount P becomes continuously larger as farther from the both ends of the protruding part 11*b* to the center of the protruding part 11*b*, across a part of the protruding part 11*b* at which part the protruding section 11*b*1 is not provided. Meanwhile, the protrusion amount P becomes discretely larger at both ends of a part of the protruding part 11*b* at which part the protruding section 11*b*1 is provided. Similarly, a protrusion amount P of the protruding part 12*b* is larger at the center of the protruding part 12*b* than at both ends of the protruding part 12*b*. Specifically, the protrusion amount P becomes continuously larger as farther from the both ends of the protruding part 12*b* to the center of the protruding part 12*b*, across a part of the protruding part 12*b* at which part the protruding section 12*b*1 is not provided. Meanwhile, the protrusion amount P becomes discretely larger at both ends of a part of the protruding part 12*b* at which part the protruding section 12*b*1 is provided.

A width Wb1 of each of the protruding sections 11*b*1 and 12*b*1 can be determined as appropriate, within such a range that the width Wb1 is shorter than a length L of the each of the protruding parts 11*b* and 12*b*, so as to control S(1,1) and S(1,4). Furthermore, a protrusion amount PB1 of each of the protruding sections 11*b*1 and 12*b*1 can be determined as appropriate, within such a range that the protrusion amount PB1 is narrower than a width W1 at a first port P1 and a width W2 at a fourth port P4, so as to control S(1,1) and S(1,4).

Embodiment 2

Figure 11:
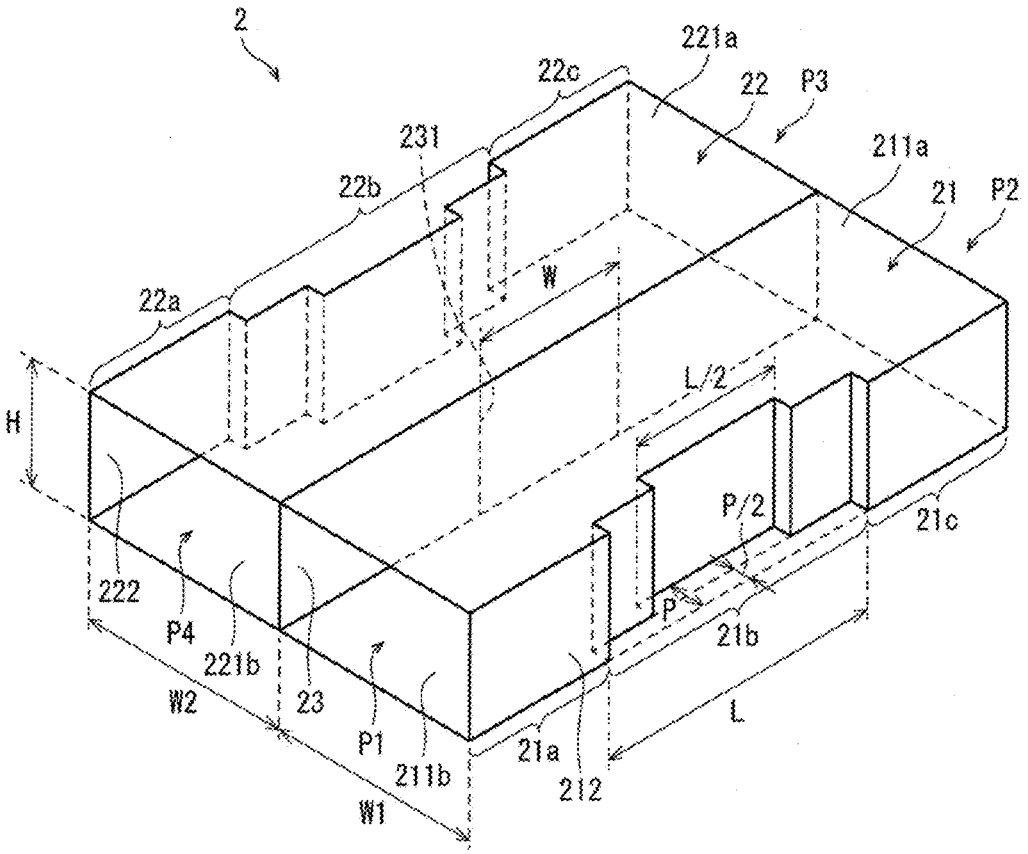
FIG. 11 is a perspective view illustrating a configuration of a directional coupler in accordance with Embodiment 2 of the present invention.

With reference to FIG. 11, the following description will discuss a directional coupler in accordance with Embodiment 2 of the present invention. FIG. 11 is a perspective view illustrating a configuration of a directional coupler 2 in accordance with Embodiment 2 of the present invention.

The directional coupler 2 is obtained by replacing the protruding parts 11*b* and 12*b* of the directional coupler 1 in accordance with Embodiment 1 with protruding parts 21*b* and 22*b*, respectively. A configuration of each of the protruding parts 21*b* and 22*b* will be mainly described below.

As illustrated in FIG. 11, the directional coupler 2 includes a first waveguide 21 and a second waveguide 22. The first waveguide 21 and the second waveguide 22 correspond to the first waveguide 11 and the second waveguide 12, respectively, of the directional coupler 1. The first waveguide 21 and the second waveguide 22 share a narrow wall 23 which is a first narrow wall out of a pair of narrow walls constituting each of the first waveguide 21 and the second waveguide 22. The narrow wall 23 has an opening 231 having a width W. The directional coupler 2 is similar to the directional coupler 1 in the above configuration.

The first waveguide 21 includes the protruding part 21*b* which (i) is a part of a narrow wall 212 facing the opening 231, (ii) is provided between a first part 21*a* having a uniform width W1 and a second part 21*c* having a uniform width W1, and (iii) protrudes toward the opening 231. A protrusion amount P by which the protruding part 21*b* of the narrow wall 212 protrudes toward the narrow wall 23 is larger at a center of the protruding part 21*b* than at both ends of the protruding part 21*b* (a part where the protruding part 21*b* is connected with the first part 21*a* and a part where the protruding part 21*b* is connected with the second part 21*b*). More specifically, the protrusion amount P becomes discretely larger as farther from the both ends of the protruding part 21*b* to the center of the protruding part 21*b*. In other words, the width W1 becomes discretely narrower as farther from the both ends of the protruding part 21*b* to the center of the protruding part 21*b*.

Similarly, the second waveguide 22 includes the protruding part 22*b* which (i) is a part of a narrow wall 222 facing the opening 231, (ii) is provided between a first part 22*a* having a uniform width W2 and a second part 22*c* having a uniform width W2, and (iii) protrudes toward the opening 231. A protrusion amount P by which the protruding part 22*b* of the narrow wall 222 protrudes toward the narrow wall 23 is larger at a center of the protruding part 22*b* than at both ends of the protruding part 22*b* (a part where the protruding part 22*b* is connected with the first part 22*a* and a part where the protruding part 22*b* is connected with the second part 22*c*). More specifically, the protrusion amount P becomes discretely larger as farther from the both ends of the protruding part 22*b* to the center of the protruding part 22*b*. In other words, the width W2 becomes discretely narrower as farther from the both ends of the protruding part 22*b* to the center of the protruding part 22*b*.

Thus, the directional coupler 2 is a directional coupler of a step taper type.

Each of the respective protruding parts 21*b* and 22*b* of the narrow walls 212 and 222 protrudes twice toward the opening 231. Specifically, the narrow wall 212 (i) protrudes by P/2 at the both ends of the protruding part 21*b* and (ii) protrudes by P/2 at positions which are L/4 away from the respective both ends of the protruding part 21*b* toward the center of the protruding part 21*b*. Similarly, the narrow wall 222 (i) protrudes by P/2 at the both ends of the protruding part 22*b* and (ii) protrudes by P/2 at positions which are L/4 away from the respective both ends of the protruding part 22*b* toward the center of the protruding part 22*b*.

Note that each of the respective protruding parts 21*b* and 22*b* of the narrow walls 212 and 222 protrudes twice stepwise. However, the number of times of protrusion of each of the narrow walls 212 and 222 is not particularly limited, provided that each of the narrow walls 212 and 222 protrude a plurality of times.

Example 21

Figure 12:
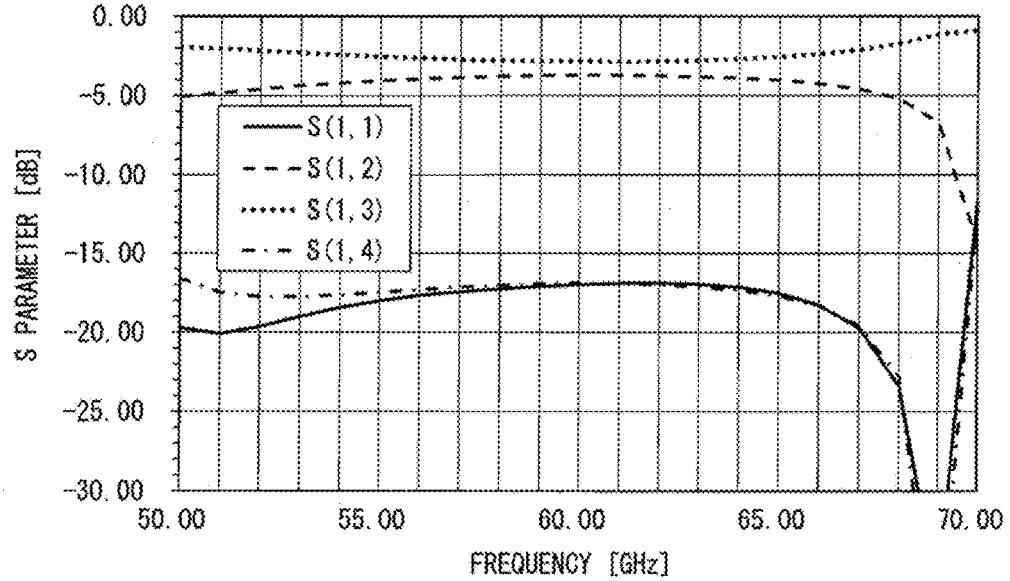
FIG. 12 is a graph illustrating a frequency dependency of S parameters of a directional coupler in accordance with Example 2 of the present invention.

With reference to FIG. 12, the following description will discuss a directional coupler in accordance with Example 2 of the present invention. A directional coupler 2 in accordance with Example 2 is obtained by setting parameters of the directional coupler 2 in accordance with Embodiment 2 as follows.

A width W1 and a width W2 were each set to 1.94 mm.

A height H was set to 0.5 mm.

A specific inductive capacity of a dielectric material with which each of waveguides 21 and 22 was filled was set to 3.823.

A width W was set to 2.85 mm.

A length L was set to 2.4 mm.

A protrusion amount P was set to 300 μm.

An operation frequency set at the time of design of the directional coupler 2 in accordance with Example 2 was 60 GHz. A high-frequency signal with a frequency of 60 GHz had (i) a wavelength of 5.00 mm in a free space and (ii) a wavelength of 2.56 mm in the dielectric material with a specific inductive capacity of 3.823. The high-frequency signal with a frequency of 60 GHz had a guide wavelength of 3.40 mm in the directional coupler 2 configured as above.

The directional coupler 2 in accordance with Example 2 was designed as a directional coupler having a coupling degree of 3 dB.

FIG. 12 illustrates a result of calculation of a frequency dependency of S parameters with use of the directional coupler 2 in accordance with Example 2. FIG. 12 is a graph illustrating a frequency dependency of S parameters of the directional coupler 2 in accordance with Example 2.

As is clear from FIG. 12, S(1,1) and S(1,4) were each less than −13 dB in a frequency domain of not less than 50 GHz and not more than 69 GHz. That is, it is found that the directional coupler 2 in accordance with Example 2 can cut return losses in a frequency domain of not less than 50 GHz and not more than 69 GHz including a frequency of 60 GHz which is an operation frequency set at the time of the design. Furthermore, in a frequency domain of not less than 59 GHz and not more than 62 GHz, a difference between S(1,2) and S(1,3) was less than 1.0 dB. That is, it is found that the directional coupler 2 in accordance with Example 2 operates more suitably, as a directional coupler having a coupling degree of 3 dB, in a frequency domain of not less than 59 GHz and not more than 62 GHz.

[Variation 8]

Figure 13:
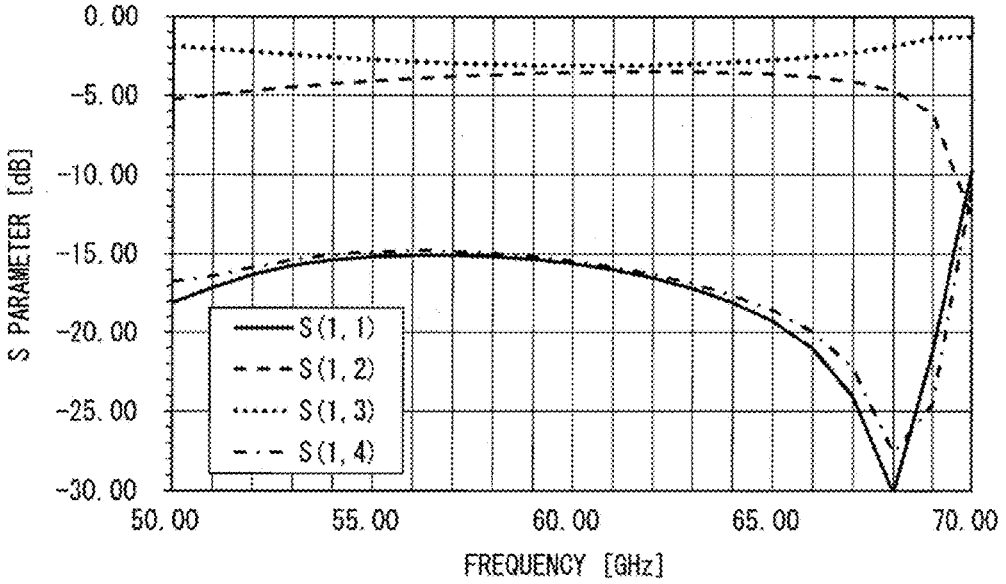
FIG. 13 is a graph illustrating a frequency dependency of S parameters of Variation 8 of the directional coupler.

With reference to FIG. 13, the following description will discuss a directional coupler in accordance with Variation 8 of the present invention. A directional coupler 2 in accordance with Variation 8 is obtained by varying, to 3.2 mm, the length L of each of the protruding parts 21*b* and 22*b* of the directional coupler 2 in accordance with Embodiment 2.

FIG. 13 illustrates a result of calculation of a frequency dependency of S parameters with use of the directional coupler 2 in accordance with Variation 8. FIG. 13 is a graph illustrating a frequency dependency of S parameters of the directional coupler 2 in accordance with Variation 8.

As is clear from FIG. 13, S(1,1) and S(1,4) were each less than −13 dB in a frequency domain of not less than 50 GHz and not more than 69 GHz. That is, it is found that the directional coupler 2 in accordance with Variation 8 can cut return losses in a frequency domain of not less than 50 GHz and not more than 69 GHz including a frequency of 60 GHz which is an operation frequency set at the time of design. Furthermore, in a frequency domain of not less than 57 GHz and not more than 65 GHz, a difference between S(1,2) and S(1,3) was less than 1.0 dB. That is, it is found that the directional coupler 2 in accordance with Variation 8 operates more suitably, as a directional coupler having a coupling degree of 3 dB, in a frequency domain of not less than 57 GHz and not more than 65 GHz.

[Variation 9]

Figure 14:
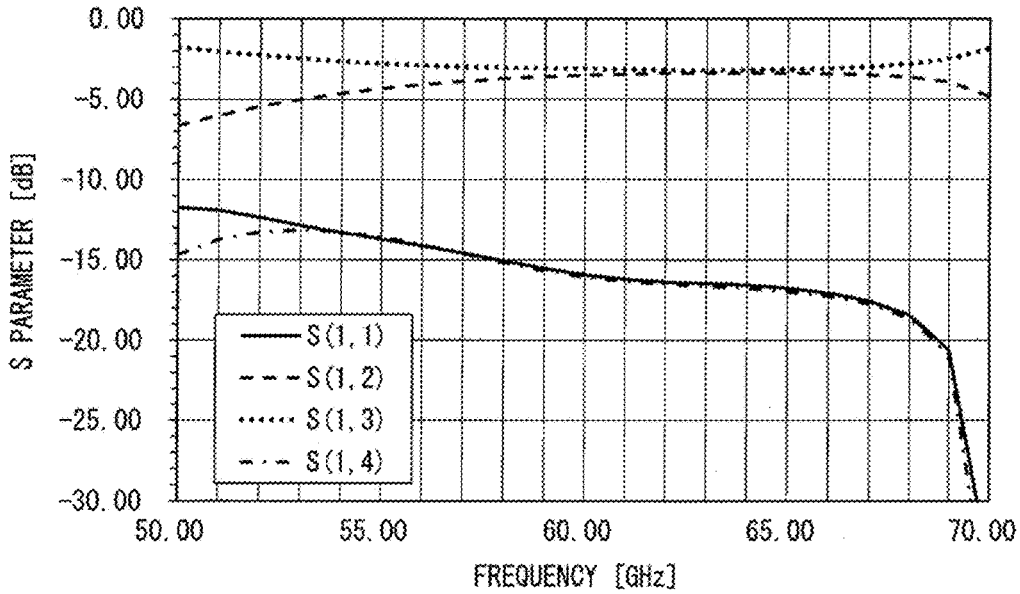
FIG. 14 is a graph illustrating a frequency dependency of S parameters of Variation 9 of the directional coupler.

With reference to FIG. 14, the following description will discuss a directional coupler in accordance with Variation 9 of the present invention. A directional coupler 2 in accordance with Variation 9 is obtained by varying, to 4.8 mm, the length L of each of the protruding parts 21*b* and 22*b* of the directional coupler 2 in accordance with Embodiment 2.

FIG. 14 illustrates a result of calculation of a frequency dependency of S parameters with use of the directional coupler 2 in accordance with Variation 9. FIG. 14 is a graph illustrating a frequency dependency of S parameters of the directional coupler 2 in accordance with Variation 9.

As is clear from FIG. 14, S(1,1) and S(1,4) were each less than −13 dB in a frequency domain of not less than 54 GHz and not more than 70 GHz. That is, it is found that the directional coupler 2 in accordance with Variation 9 can cut return losses in a frequency domain of not less than 54 GHz and not more than 70 GHz including a frequency of 60 GHz which is an operation frequency set at the time of design. Furthermore, in a frequency domain of not less than 57 GHz and not more than 68 GHz, a difference between S(1,2) and S(1,3) was less than 1.0 dB. That is, it is found that the directional coupler 2 in accordance with Variation 9 operates more suitably, as a directional coupler having a coupling degree of 3 dB, in a frequency domain of not less than 57 GHz and not more than 68 GHz.

Comparative Example 1

Figure 15:
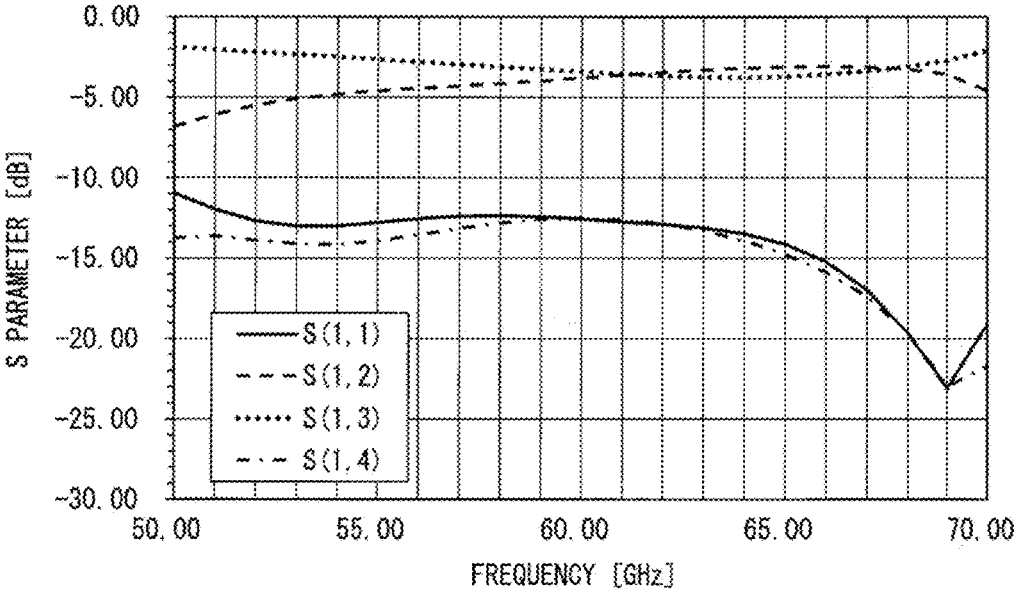
FIG. 15 is a graph illustrating a frequency dependency of S parameters of a directional coupler in accordance with a first Comparative Example of the present invention.

With reference to FIG. 15, the following description will discuss a directional coupler in accordance with Comparative Example 1 of the present invention. A directional coupler 101 in accordance with Comparative Example 1 is obtained by varying, to 6.4 mm, the length L of each of the protruding parts 21*b* and 22*b* of the directional coupler 2 in accordance with Embodiment 2.

FIG. 15 illustrates a result of calculation of a frequency dependency of S parameters with use of the directional coupler 101 in accordance with Comparative Example 1. FIG. 15 is a graph illustrating a frequency dependency of S parameters of the directional coupler 101 in accordance with Comparative Example 1.

As is clear from FIG. 15, S(1,1) and S(1,4) were each less than −13 dB in a frequency domain of not less than 66 GHz and not more than 70 GHz. That is, it is found that the directional coupler 101 in accordance with Comparative Example 1 cannot cut return losses at a frequency of 60 GHz which is an operation frequency set at the time of design.

[Variation 10]

Figure 16:
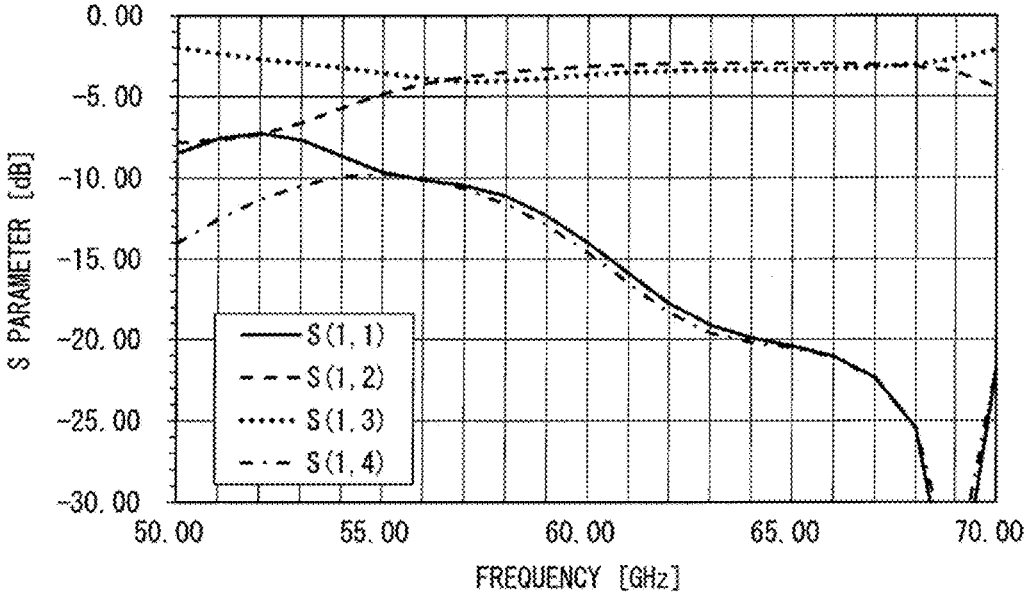
FIG. 16 is a graph illustrating a frequency dependency of S parameters of a directional coupler in accordance with Variation 10 of the present invention.

With reference to FIG. 16, the following description will discuss a directional coupler in accordance with Variation 10 of the present invention. A directional coupler 102 in accordance with Variation 10 is obtained by varying, to 8.8 mm, the length L of each of the protruding parts 21*b* and 22*b* of the directional coupler 2 in accordance with Embodiment 2.

FIG. 16 illustrates a result of calculation of a frequency dependency of S parameters with use of the directional coupler 102 in accordance with Variation 10. FIG. 16 is a graph illustrating a frequency dependency of S parameters of the directional coupler 102 in accordance with Variation 10.

As is clear from FIG. 16, S(1,1) and S(1,4) were each less than −13 dB in a frequency domain of not less than 60 GHz and not more than 70 GHz. That is, it is found that the directional coupler 102 in accordance with Variation 10 can cut return losses in a frequency domain of not less than 60 GHz and not more than 70 GHz including a frequency of 60 GHz which is an operation frequency set at the time of design. Furthermore, in a frequency domain of not less than 59 GHz and not more than 69 GHz, a difference between S(1,2) and S(1,3) was less than 1.0 dB. That is, it is found that the directional coupler 102 in accordance with Variation 10 operates more suitably, as a directional coupler having a coupling degree of 3 dB, in a frequency domain of not less than 59 GHz and not more than 69 GHz.

Reference Embodiment

Figure 17:
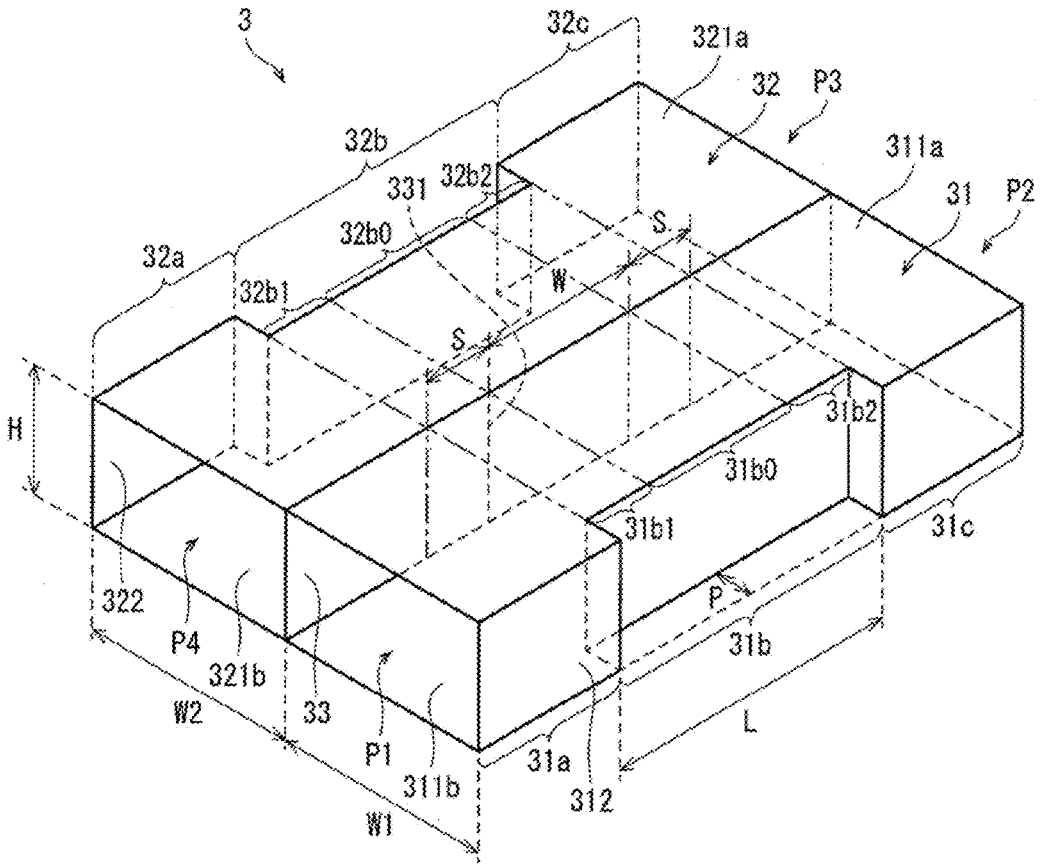
FIG. 17 is a perspective view illustrating a configuration of a directional coupler in accordance with a reference embodiment of the present invention.

With reference to FIG. 17, the following description will discuss a directional coupler in accordance with the reference embodiment of the present invention. FIG. 17 is a perspective view illustrating a configuration of a directional coupler 3 in accordance with the reference embodiment.

The directional coupler 3 is obtained by replacing the protruding parts 11*b* and 12*b* of the directional coupler 1 in accordance with Embodiment 1 with protruding parts 31*b* and 32*b*, respectively. A configuration of each of the protruding parts 31*b* and 32*b* will be mainly described below.

As illustrated in FIG. 17, the directional coupler 3 includes a first waveguide 31 and a second waveguide 32. The first waveguide 31 and the second waveguide 32 correspond to the first waveguide 11 and the second waveguide 12, respectively, of the directional coupler 1. The first waveguide 31 and the second waveguide 32 share a narrow wall 33 which is a first narrow wall out of a pair of narrow walls constituting each of the first waveguide 31 and the second waveguide 32. The narrow wall 33 has an opening 331 having a width W. The directional coupler 3 is similar to the directional coupler 1 in the above configuration.

The first waveguide 31 includes the protruding part 31*b* which (i) is a part of a narrow wall 312 facing the opening 331, (ii) is provided between a first part 31*a* having a uniform width W1 and a second part 31*c* having a uniform width W1, and (iii) protrudes toward the opening 331. A protrusion amount P by which the protruding part 31*b* protrudes is uniform. A length L of the protruding part 31*b* is set so as to be not less than 1.68 times as great as the width W of the opening 331.

Similarly, the second waveguide 32 includes the protruding part 32*b* which (i) is a part of a narrow wall 322 facing the opening 331, (ii) is provided between a first part 32*a* having a uniform width W2 and a second part 32*c* having a uniform width W2, and (iii) protrudes toward the opening 331. A protrusion amount P by which the protruding part 32*b* protrudes is uniform. A length L of the protruding part 32*b* is set so as to be not less than 1.68 times as great as the width W of the opening 331.

Thus, the directional coupler 3 is a directional coupler of a step type, and is configured such that the length L is set so as to be not less than 1.68 times as great as the width W.

The protruding part 31*b* of the first waveguide 31 can be divided into three parts: an opening part 31*b*0, a first non-opening part 31*b*1, and a second non-opening part 31*b*2 (see FIG. 17). The opening part 31*b*0 is a part that has a beginning end and a finishing end at respective both ends of the opening 331. The first non-opening part 31*b*1 is a part provided at a previous stage of the opening part 31*b*0 and having a beginning end at one end of the protruding part 31*b* and a finishing end at one end of the opening 331. The second non-opening part 31*b*2 is a part provided at a subsequent stage of the opening part 31*b*0 and having a beginning end at the other end of the opening 331 and a finishing end at the other end of the protruding part 31*b*. The first non-opening part 31*b*1 and the second non-opening part 31*b*2 of the protruding part 31*b* have a common length S.

Similarly, the protruding part 32*b* of the second waveguide 32 can be divided into three parts: an opening part 32*b*0, a first non-opening part 32*b*1, a second non-opening part 32*b*2 (see FIG. 17). The opening part 32*b*0 is a part that has a beginning end and a finishing end at respective both ends of the opening 331. The first non-opening part 32*b*1 is a part provided at a previous stage of the opening part 32*b*0 and having a beginning end at one end of the protruding part 32*b* and a finishing end at one end of the opening 331. The second non-opening part 32*b*2 is a part provided at a subsequent stage of the opening part 32*b*0 and having a beginning end at the other end of the opening 331 and a finishing end at the other end of the protruding part 32*b*. The first non-opening part 32*b*1 and the second non-opening part 32*b*2 of the protruding part 32*b* have a common length S.

The directional coupler 3 configured as above preferably has a length S that satisfies the following Formula (1):

$$(\lambda g/2)\times n\times 0.8\leq S\leq(\lambda g/2)\times n\times 1.2 \quad (1)$$

where λg is a guide wavelength for a case in which a high-frequency signal having a target operation frequency in design is guided in the first waveguide 31 and the second waveguide 32, and n is a positive integer.

The above arrangement makes it possible to further reduce S(1,1) and S(1,4) at the operation frequency set at the time of design. This is presumably because a length S that satisfies Formula (1) or (2) allows for an offset between (i) a high-frequency signal reflected at each of the respective beginning ends of the first non-opening parts 31*b*1 and 32*b*1 and (ii) a high-frequency signal reflected at each of the respective finishing ends of the first non-opening parts 31*b*1 and 32*b*1. This means that preferable ranges of the length S occur periodically depending on the guide wavelength λg.

The length S more preferably satisfies the following Formula (2):

$$(\lambda g/2)\times 0.8 \leq S \leq (\lambda g/2)\times 1.2 \quad (2)$$

Formula (2) corresponds to Formula (1) for a case in which n=1. As described later with reference to FIGS. 21 through 26, as compared to using a length S that satisfies n=2 or 3, using a length S that satisfies n=1 can extend, to the low-frequency side, a lower limit value for a frequency band in which return losses can be reduced to not more than −13 dB.

Reference Example

With reference to FIG. 17, the following description will discuss a directional coupler 3 in accordance with the reference example of the present invention. A directional coupler 3 present in accordance with the reference example is obtained by setting parameters of the directional coupler 3 in accordance with the reference embodiment as follows:

A width W1 and a width W2 were each set to 1.94 mm.

A height H was set to 0.5 mm.

A specific inductive capacity of a dielectric material with which each of waveguides 31 and 32 was filled was set to 3.823.

A width W was set to 2.85 mm.

A length L was set to 4.8 mm, which was 1.68 times the width W. Further, a length S was 0.975 mm, which is equivalent to 0.287 λg.

A protrusion amount P was set to 300 μm.

An operation frequency set at the time of design of the directional coupler 3 in accordance with the present reference example was 60 GHz. A high-frequency signal with a frequency of 60 GHz had (i) a wavelength of 5.00 mm in a free space and (ii) a wavelength of 2.56 mm in the dielectric material with a specific inductive capacity of 3.823. The high-frequency signal with a frequency of 60 GHz had a guide wavelength λg of 3.40 mm in the directional coupler 3 configured as above.

The directional coupler 3 in accordance with the present reference example was designed as a directional coupler having a coupling degree of 3 dB.

Figure 18:
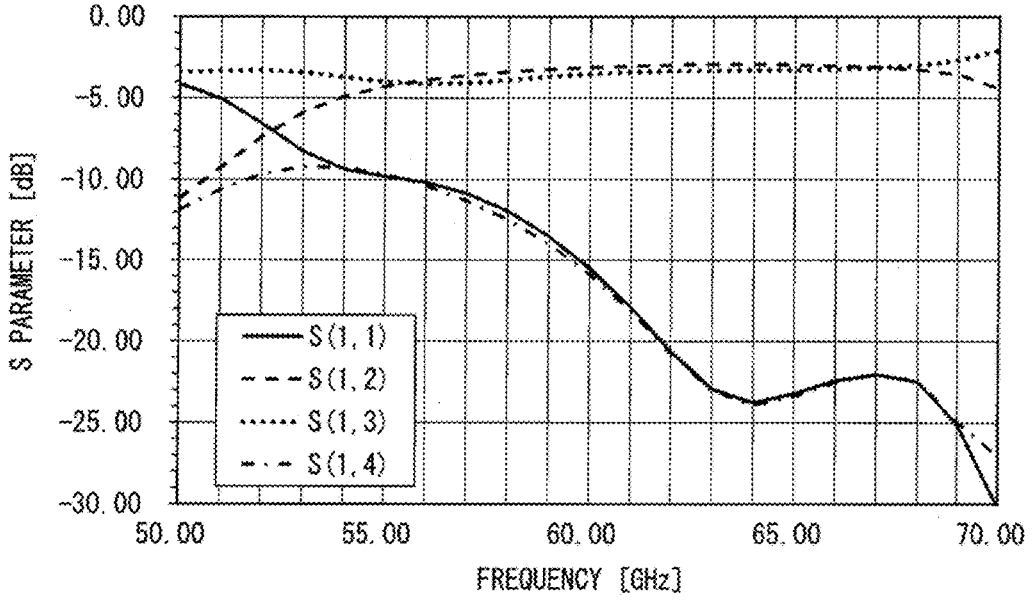
FIG. 18 is a graph illustrating a frequency dependency of S parameters of a directional coupler in accordance with a reference example of the present invention.

FIG. 18 illustrates a result of calculation of a frequency dependency of S parameters with use of the directional coupler 3 in accordance with the present reference example. FIG. 18 is a graph illustrating a frequency dependency of S parameters of the directional coupler 3 in accordance with the present reference example.

As is clear from FIG. 18, S(1,1) and S(1,4) were each less than −13 dB in a frequency domain of not less than 59 GHz and not more than 70 GHz. That is, it is found that the directional coupler 3 in accordance with the present reference example can cut return losses in a frequency domain of not less than 59 GHz and not more than 70 GHz including a frequency of 60 GHz which is an operation frequency set at the time of the design. Furthermore, in a frequency domain of not less than 55 GHz and not more than 69 GHz, a difference between S(1,2) and S(1,3) was less than 1.0 dB. That is, it is found that the directional coupler 1 in accordance with Example 1 operates more suitably, as a directional coupler having a coupling degree of 3 dB, in a frequency domain of not less than 59 GHz and not more than 69 GHz.

[Variation 11]

Figure 19:
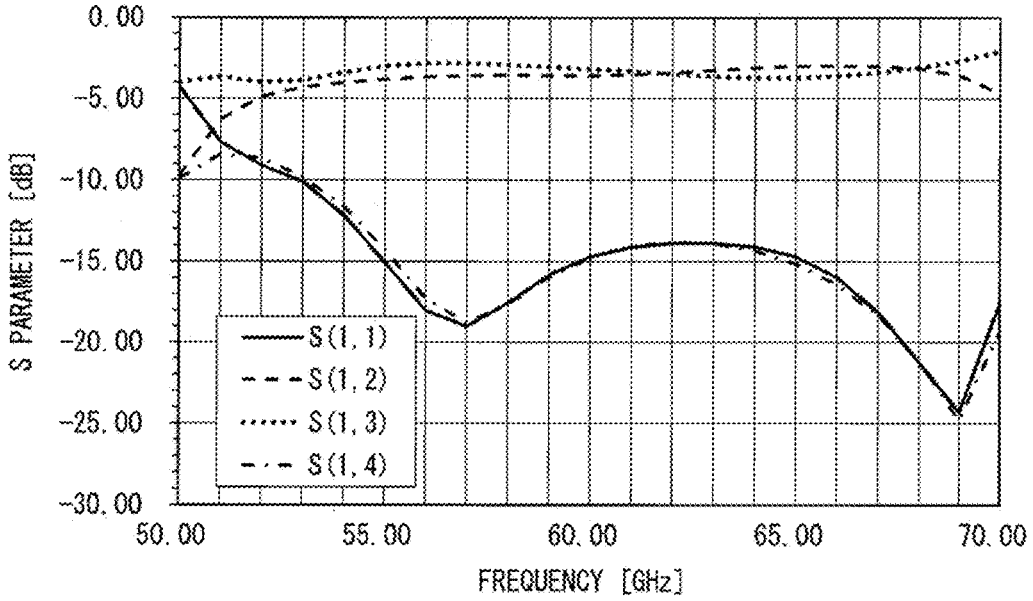
FIG. 19 is a graph illustrating a frequency dependency of S parameters of a directional coupler in accordance with Variation 11 of the present invention.

With reference to FIG. 19, the following description will discuss a directional coupler in accordance with Variation 11 of the present invention. A directional coupler 3 in accordance with Variation 11 is obtained by varying, to 6.4 mm, the length L of each of the protruding parts 31*b* and 32*b* of the directional coupler 3 in accordance with the reference example. This means that in the present variation, the length L is 2.25 times the width W. Further, a length S is 1.775 mm, which is equivalent to 0.522 λg.

FIG. 19 shows the result of calculation of a frequency dependency of S parameters with use of the directional coupler 3 in accordance with Variation 11. FIG. 19 is a graph showing a frequency dependency of S parameters of the directional coupler 3 in accordance with Variation 11.

As is clear from FIG. 19, S(1,1) and S(1,4) were each less than −13 dB in a frequency domain of not less than 55 GHz and not more than 70 GHz. That is, it is found that the directional coupler 3 in accordance with Variation 11 can cut return losses in the frequency domain of not less than 55 GHz and not more than 70 GHz including a frequency of 60 GHz which is an operation frequency set at the time of the design. Furthermore, in a frequency domain of not less than 52 GHz and not more than 69 GHz, a difference between S(1,2) and S(1,3) was less than 1.0 dB. That is, it is found that the directional coupler 3 operates more suitably, as a directional coupler having a coupling degree of 3 dB, in a frequency domain of not less than 55 GHz and not more than 69 GHz.

[Variation 12]

Figure 20:
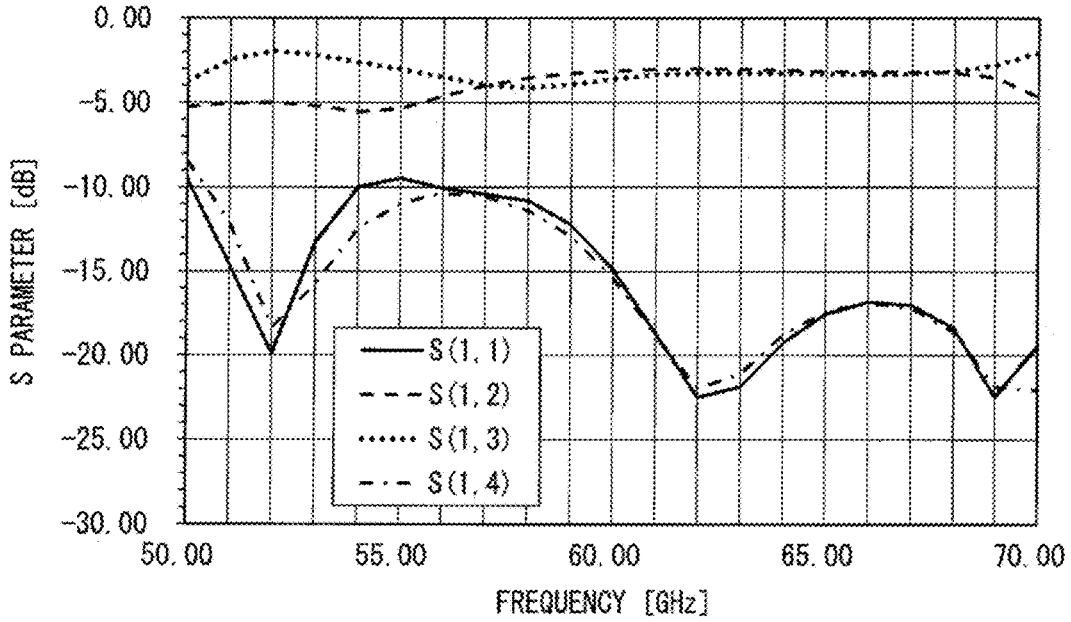
FIG. 20 is a graph illustrating a frequency dependency of S parameters of Variation 12 of the directional coupler.

With reference to FIG. 20, the following description will discuss a directional coupler in accordance with Variation 12 of the present invention. A directional coupler 3 in accordance with Variation 12 is obtained by varying, to 8.8 mm, the length L of each of the protruding parts 31*b* and 32*b* of the directional coupler 3 in accordance with the reference example. This means that in the present variation, the length L is 3.09 times the width W. Further, the length S is 2.975 mm, which is equivalent to 0.875 λg.

FIG. 20 shows the result of calculation of a frequency dependency of S parameters with use of the directional coupler 3 in accordance with Variation 12. FIG. 20 is a graph showing a frequency dependency of S parameters of the directional coupler 3 in accordance with Variation 12.

As is clear from FIG. 20, S(1,1) and S(1,4) were each less than −13 dB in a frequency domain of not less than 60 GHz and not more than 70 GHz. That is, it is found that the directional coupler 3 in accordance with Variation 12 can cut return losses in the frequency domain of not less than 60 GHz and not more than 70 GHz including a frequency of 60 GHz which is an operation frequency set at the time of the design. Furthermore, in a frequency domain of not less than 57 GHz and not more than 69 GHz, a difference between S(1,2) and S(1,3) was less than 1.0 dB. That is, it is found that the directional coupler 3 operates more suitably, as a directional coupler having a coupling degree of 3 dB, in a frequency domain of not less than 60 GHz and not more than 69 GHz.

[Variation 13]

Figure 21:
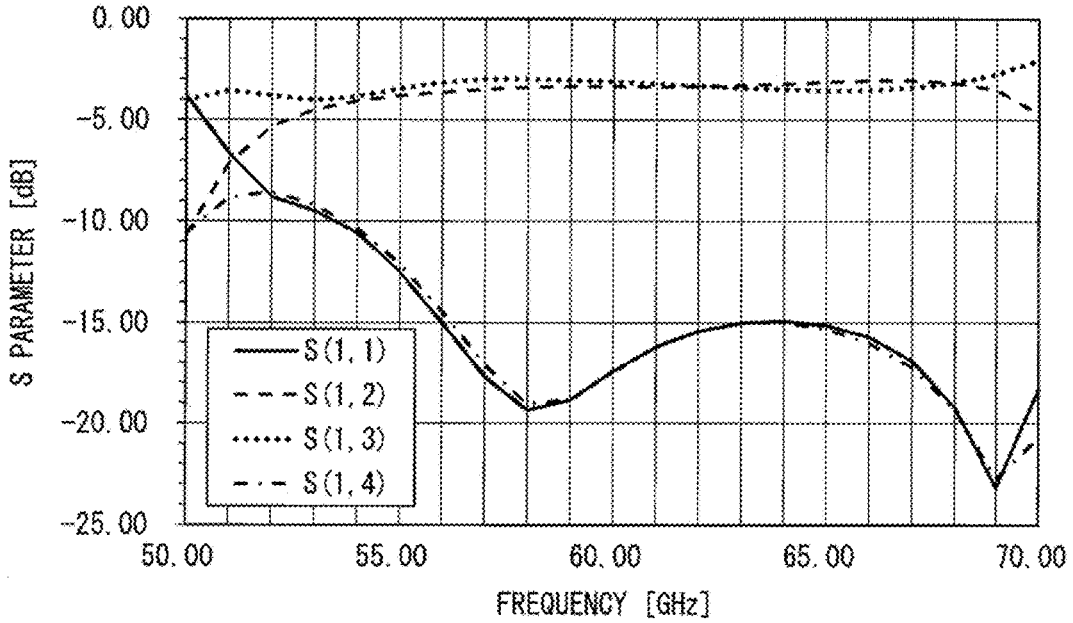
FIG. 21 is a graph illustrating a frequency dependency of S parameters of Variation 13 of the directional coupler.

With reference to FIG. 21, the following description will discuss a directional coupler in accordance with Variation 13 of the present invention. A directional coupler 3 in accordance with Variation 13 is obtained by varying, to 6.0 mm, the length L of each of the protruding parts 31*b* and 32*b* of the directional coupler 3 in accordance with the reference example. This means that in the present variation, the length L is 2.11 times the width W. Further, the length S is 1.575 mm, which is equivalent to 0.463 λg.

FIG. 21 shows the result of calculation of a frequency dependency of S parameters with use of the directional coupler 3 in accordance with Variation 13. FIG. 21 is a graph showing a frequency dependency of S parameters of the directional coupler 3 in accordance with Variation 13.

As is clear from FIG. 21, S(1,1) and S(1,4) were each less than −13 dB in a frequency domain of not less than 55 GHz and not more than 70 GHz. That is, it is found that the directional coupler 3 in accordance with Variation 13 can cut return losses in the frequency domain of not less than 55 GHz and not more than 70 GHz including a frequency of 60 GHz which is an operation frequency set at the time of the design. Furthermore, in a frequency domain of not less than 53 GHz and not more than 69 GHz, a difference between S(1,2) and S(1,3) was less than 1.0 dB. That is, it is found that the directional coupler 3 operates more suitably, as a directional coupler having a coupling degree of 3 dB, in a frequency domain of not less than 55 GHz and not more than 69 GHz.

[Variation 14]

Figure 22:
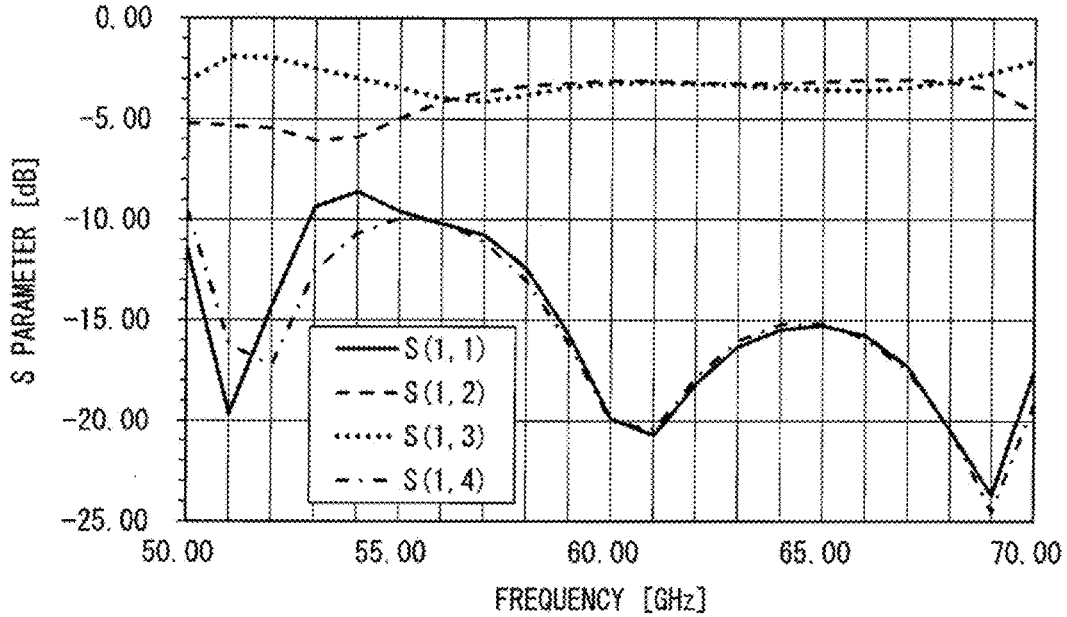
FIG. 22 is a graph illustrating a frequency dependency of S parameters of Variation 14 of the directional coupler.

With reference to FIG. 22, the following description will discuss a directional coupler in accordance with Variation 14 of the present invention. A directional coupler 3 in accordance with Variation 14 is obtained by varying, to 9.4 mm, the length L of each of the protruding parts 31*b* and 32*b* of the directional coupler 3 in accordance with the reference example. This means that in the present variation, the length L is 3.30 times the width W. Further, the length S is 3.275 mm, which is equivalent to 0.963 λg.

FIG. 22 shows the result of calculation of a frequency dependency of S parameters with use of the directional coupler 3 in accordance with Variation 14. FIG. 22 is a graph showing a frequency dependency of S parameters of the directional coupler 3 in accordance with Variation 14.

As is clear from FIG. 22, S(1,1) and S(1,4) were each less than −13 dB in a frequency domain of not less than 58 GHz and not more than 70 GHz. That is, it is found that the directional coupler 3 in accordance with Variation 14 can cut return losses in the frequency domain of not less than 58 GHz and not more than 70 GHz including a frequency of 60 GHz which is an operation frequency set at the time of the design. Furthermore, in a frequency domain of not less than 56 GHz and not more than 69 GHz, a difference between S(1,2) and S(1,3) was less than 1.0 dB. That is, it is found that the directional coupler 3 operates more suitably, as a directional coupler having a coupling degree of 3 dB, in a frequency domain of not less than 58 GHz and not more than 69 GHz.

[Variation 15]

Figure 23:
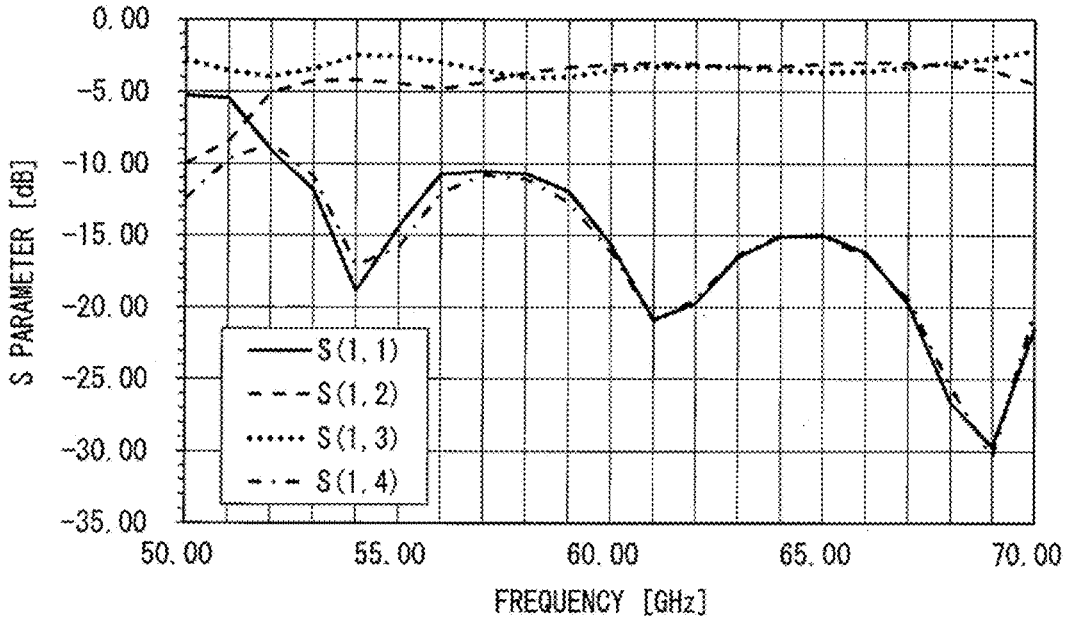
FIG. 23 is a graph illustrating a frequency dependency of S parameters of Variation 15 of the directional coupler.

With reference to FIG. 23, the following description will discuss a directional coupler in accordance with Variation 15 of the present invention. A directional coupler 3 in accordance with Variation 15 is obtained by varying, to 13 mm, the length L of each of the protruding parts 31*b* and 32*b* of the directional coupler 3 in accordance with the reference example. This means that in the present variation, the length L is 4.56 times the width W. Further, the length S is 5.075 mm, which is equivalent to 1.49 λg.

FIG. 23 shows the result of calculation of a frequency dependency of S parameters with use of the directional coupler 3 in accordance with Variation 15. FIG. 23 is a graph showing a frequency dependency of S parameters of the directional coupler 3 in accordance with Variation 15.

As is clear from FIG. 23, S(1,1) and S(1,4) were each less than −13 dB in a frequency domain of not less than 60 GHz and not more than 70 GHz. That is, it is found that the directional coupler 3 in accordance with Variation 15 can cut return losses in the frequency domain of not less than 60 GHz and not more than 70 GHz including a frequency of 60 GHz which is an operation frequency set at the time of the design. Furthermore, in a frequency domain of not less than 57 GHz and not more than 69 GHz, a difference between S(1,2) and S(1,3) was less than 1.0 dB. That is, it is found that the directional coupler 3 operates more suitably, as a directional coupler having a coupling degree of 3 dB, as in a frequency domain of not less than 60 GHz and not more than 69 GHz.

Of Variations 11 to 15, Variations 11 and 13 each use a length S that satisfies Formula (1) for a case in which n=1, that is, Formula (2), Variations 12 and 14 each use a length S that satisfies Formula (1) for a case in which n=2, and Variation 15 uses a length S that satisfies Formula (1) for a case in which n=3. The description below refers to (i) Variations 11 and 13 as a variation group that satisfies n=1, (ii) Variations 12 and 14 as a variation group that satisfies n=2, and (iii) Variation 15 as a variation that satisfies n=3.

A comparison between FIGS. 19 through 23 shows that a lower limit value for a frequency band in which return losses can be reduced to not more than −13 dB is the lowest (54.5 GHz and 55.5 GHz) for the variation group that satisfies n=1, shifted to the high-frequency side (58 GHz and 59.3 GHz) for the variation group that satisfies n=2, and shifted further to the high-frequency side (59.5 GHz) for the variation that satisfies n=3. This indicates that as compared to using a length S that satisfies n=2 or 3, using a length S that satisfies n=1 can extend, to the low-frequency side, a lower limit value for a frequency band in which return losses can be reduced to not more than −13 dB.

[Variations 16 to 18]

Figure 24:
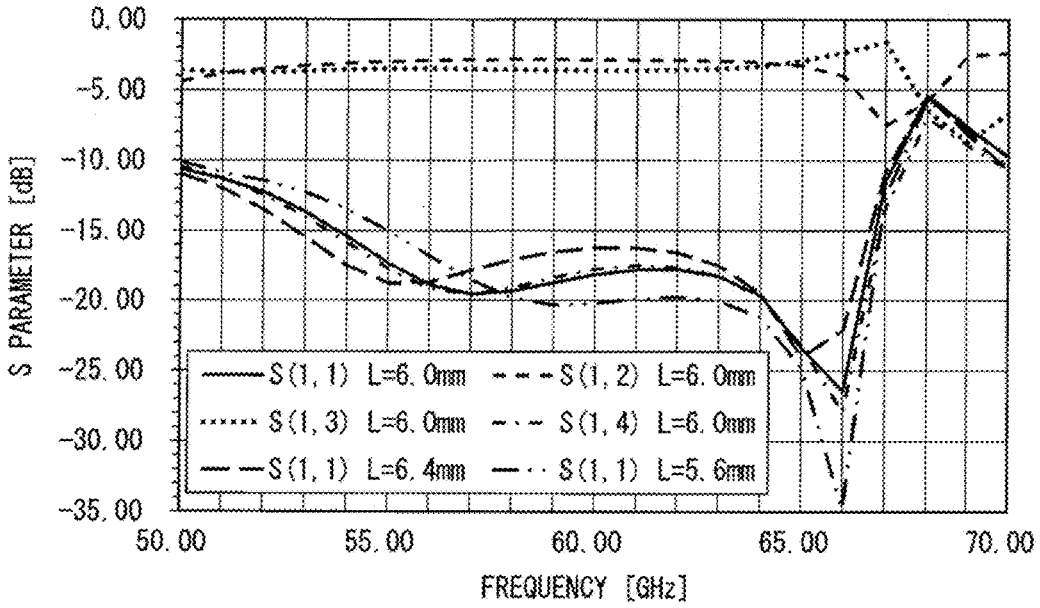
FIG. 24 is a graph illustrating a frequency dependency of S parameters of each of Variations 16 to 18 of the directional coupler.

With reference to FIG. 24, the following description will discuss respective directional couplers in accordance with Variations 16 to 18 of the present invention. A directional coupler 3 in accordance with Variation 16 corresponds to a directional coupler 3 in accordance with the reference example which directional coupler 3 is varied to have a protrusion amount P of 200 μm and protruding parts 31*b* and 32*b* each having a length L of 6.0 mm. The respective directional couplers 3 in accordance with Variations 17 and 18 are each obtained by varying, to 6.4 mm or 5.6 mm respectively, the length L of each of the protruding parts 31*b* and 32*b* of the directional coupler 3 in accordance with Variation 16. This means that in Variations 16 to 18, the respective lengths L are 2.11 times, 2.25 times, and 1.96 times the width W. In Variation 16, the length S is 1.575 mm, which is equivalent to 0.463 λg. In Variation 17, the length S is 1.775 mm, which is equivalent to 0.522 λg. In Variation 18, the length S is 1.375 mm, which is equivalent to 0.404 λg.

FIG. 24 shows the result of calculation of a frequency dependency of S parameters with use of the directional coupler 3 in accordance with each of Variations 16 to 18. FIG. 24 is a graph showing a frequency dependency of S parameters of the directional coupler 3 in accordance with each of Variations 16 to 18. FIG. 24 shows only S(1,1) for the directional coupler 3 in accordance with each of Variations 17 and 18.

As is clear from FIG. 24, S(1,1) and S(1,4) for the directional coupler 3 in accordance with Variation 16 were each less than −13 dB in a frequency domain of not less than 53 GHz and not more than 67 GHz. That is, it is found that the directional coupler 3 in accordance with Variation 16 can cut return losses in the frequency domain of not less than 53

GHz and not more than 67 GHz including a frequency of 60 GHz which is an operation frequency set at the time of the design. Furthermore, in a frequency domain of not less than 50 GHz and not more than 65 GHz, a difference between S(1,2) and S(1,3) was less than 1.0 dB. That is, it is found that the directional coupler 3 operates more suitably, as a directional coupler having a coupling degree of 3 dB, in a frequency domain of not less than 53 GHz and not more than 65 GHz.

S(1,1) and S(1,4) for the directional coupler 3 in accordance with Variation 17 were each less than −13 dB in a frequency domain of not less than 52 GHz and not more than 67 GHz. That is, it is found that the directional coupler 3 in accordance with Variation 17 can cut return losses in the frequency domain of not less than 52 GHz and not more than 67 GHz including a frequency of 60 GHz which is an operation frequency set at the time of the design.

S(1,1) and S(1,4) for the directional coupler 3 in accordance with Variation 18 were each less than −13 dB in a frequency domain of not less than 54 GHz and not more than 67 GHz. That is, it is found that the directional coupler 3 in accordance with Variation 18 can cut return losses in the frequency domain of not less than 54 GHz and not more than 67 GHz including a frequency of 60 GHz which is an operation frequency set at the time of the design.

[Variations 19 to 21]

Figure 25:
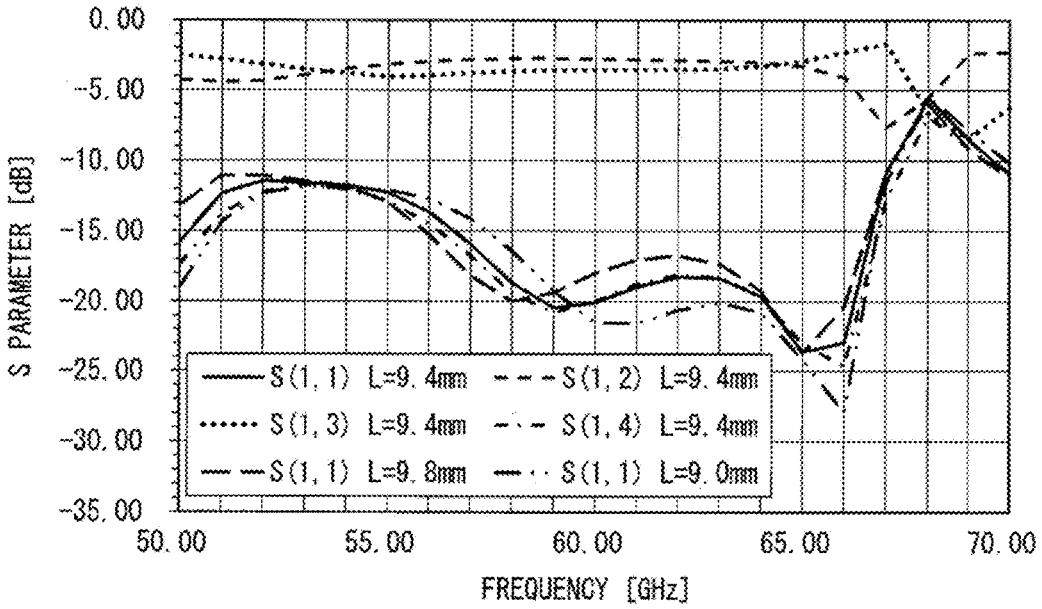
FIG. 25 is a graph illustrating a frequency dependency of S parameters of each of Variations 19 to 21 of the directional coupler.

With reference to FIG. 25, the following description will discuss respective directional couplers in accordance with Variations 19 to 21 of the present invention. A directional coupler 3 in accordance with Variation 19 is obtained by varying, to 9.4 mm, the length L of each of the protruding parts 31*b* and 32*b* of the directional coupler 3 in accordance with Variation 16. The respective directional couplers 3 in accordance with Variations 20 and 21 are each obtained by varying, to 9.8 mm or 9.0 mm respectively, the length L of each of the protruding parts 31*b* and 32*b* of the directional coupler 3 in accordance with Variation 16. This means that in Variations 19 to 21, the respective lengths L are 3.30 times, 3.44 times, and 3.16 times the width W. In Variation 19, the length S is 3.275 mm, which is equivalent to 0.963 λg. In Variation 20, the length S is 3.475 mm, which is equivalent to 1.02 λg. In Variation 21, the length S is 3.075 mm, which is equivalent to 0.904 λg.

FIG. 25 shows the result of calculation of a frequency dependency of S parameters with use of the directional coupler 3 in accordance with each of Variations 19 to 21. FIG. 25 is a graph showing a frequency dependency of S parameters of the directional coupler 3 in accordance with each of Variations 19 to 21. FIG. 25 shows only S(1,1) for the directional coupler 3 in accordance with each of Variations 20 and 21.

As is clear from FIG. 25, S(1,1) and S(1,4) for the directional coupler 3 in accordance with Variation 19 were each less than −13 dB in a frequency domain of not less than 56 GHz and not more than 67 GHz. That is, it is found that the directional coupler 3 in accordance with Variation 19 can cut return losses in the frequency domain of not less than 56 GHz and not more than 67 GHz including a frequency of 60 GHz which is an operation frequency set at the time of the design. Furthermore, in a frequency domain of not less than 53 GHz and not more than 65 GHz, a difference between S(1,2) and S(1,3) was less than 1.0 dB. That is, it is found that the directional coupler 3 operates more suitably, as a directional coupler having a coupling degree of 3 dB, as in a frequency domain of not less than 56 GHz and not more than 65 GHz.

S(1,1) and S(1,4) for the directional coupler 3 in accordance with Variation 20 were each less than −13 dB in a frequency domain of not less than 55 GHz and not more than 67 GHz. That is, it is found that the directional coupler 3 in accordance with Variation 20 can cut return losses in the frequency domain of not less than 55 GHz and not more than 67 GHz including a frequency of 60 GHz which is an operation frequency set at the time of the design.

S(1,1) and S(1,4) for the directional coupler 3 in accordance with Variation 21 were each less than −13 dB in a frequency domain of not less than 56 GHz and not more than 67 GHz. That is, it is found that the directional coupler 3 in accordance with Variation 21 can cut return losses in the frequency domain of not less than 56 GHz and not more than 67 GHz including a frequency of 60 GHz which is an operation frequency set at the time of the design.

[Variations 22 to 24]

Figure 26:
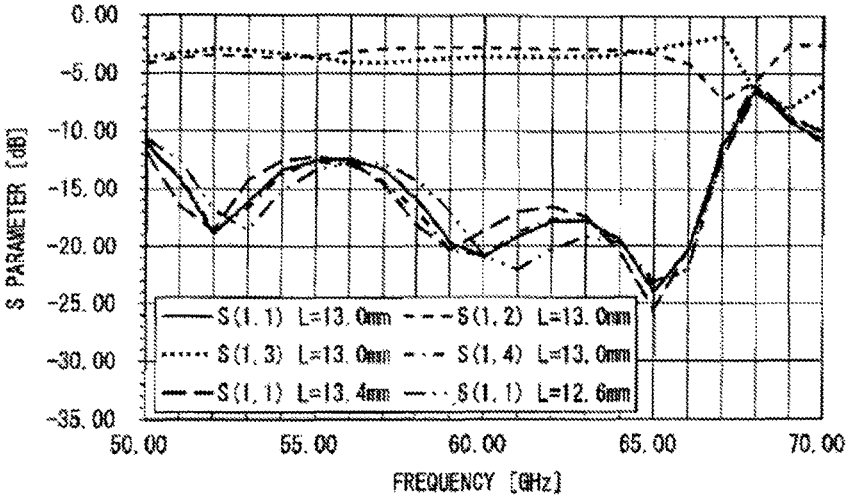
FIG. 26 is a graph illustrating a frequency dependency of S parameters of each of Variations 22 to 24 of the directional coupler.

With reference to FIG. 26, the following description will discuss respective directional couplers in accordance with Variations 22 to 24 of the present invention. A directional coupler 3 in accordance with Variation 22 is obtained by varying, to 13.0 mm, the length L of each of the protruding parts 31*b* and 32*b* of the directional coupler 3 in accordance with Variation 16. The respective directional couplers 3 in accordance with Variations 23 and 24 are each obtained by varying, to 13.4 mm or 12.6 mm respectively, the length L of each of the protruding parts 31*b* and 32*b* of the directional coupler 3 in accordance with Variation 16. This means that in Variations 22 to 24, the respective lengths L are 4.56 times, 4.70 times, and 4.42 times the width W. In Variation 22, the length S is 5.075 mm, which is equivalent to 1.49 λg. In Variation 23, the length S is 5.275 mm, which is equivalent to 1.55 λg. In Variation 24, the length S is 4.875 mm, which is equivalent to 1.43 λg.

FIG. 26 shows the result of calculation of a frequency dependency of S parameters with use of the directional coupler 3 in accordance with each of Variations 22 to 24. FIG. 26 is a graph showing a frequency dependency of S parameters of the directional coupler 3 in accordance with each of Variations 22 to 24. FIG. 26 shows only S(1,1) for the directional coupler 3 in accordance with each of Variations 23 and 24.

As is clear from FIG. 26, S(1,1) and S(1,4) for the directional coupler 3 in accordance with Variation 22 were each less than −13 dB in a frequency domain of not less than 57 GHz and not more than 67 GHz. That is, it is found that the directional coupler 3 in accordance with Variation 22 can cut return losses in the frequency domain of not less than 57 GHz and not more than 67 GHz including a frequency of 60 GHz which is an operation frequency set at the time of the design. Furthermore, in a frequency domain of not less than 50 GHz and not more than 65 GHz, a difference between S(1,2) and S(1,3) was less than 1.0 dB. That is, it is found that the directional coupler 3 operates more suitably, as a directional coupler having a coupling degree of 3 dB, as in a frequency domain of not less than 57 GHz and not more than 65 GHz.

S(1,1) and S(1,4) for the directional coupler 3 in accordance with Variation 23 were each less than −13 dB in a frequency domain of not less than 56 GHz and not more than 67 GHz. That is, it is found that the directional coupler 3 in accordance with Variation 23 can cut return losses in the frequency domain of not less than 56 GHz and not more than 67 GHz including a frequency of 60 GHz which is an operation frequency set at the time of the design.

S(1,1) and S(1,4) for the directional coupler 3 in accordance with Variation 24 were each less than −13 dB in a frequency domain of not less than 57 GHz and not more than 67 GHz. That is, it is found that the directional coupler 3 in accordance with Variation 24 can cut return losses in the frequency domain of not less than 57 GHz and not more than 67 GHz including a frequency of 60 GHz which is an operation frequency set at the time of the design.

Reference to return losses of the directional coupler 3 in accordance with the reference example (see FIG. 18) and of the respective directional couplers 3 in accordance with Variations 11 to 15 (see FIGS. 19 through 23) shows that a lower limit value for a frequency domain in which a return loss is less than −13 dB is the smallest in a case where length L=6.4 mm (see FIG. 19). Stated differently, the reference shows that in a case where length L=6.4 mm, a bandwidth of a band that covers the operation frequency of 60 GHz set at the time of the design is the widest. The reference also shows that in a case where the length L is in a range of not less than 6.4 mm and not more than 13 mm, a larger length L results in a narrower bandwidth for a band that covers the operation frequency of 60 GHz set at the time of the design.

Of Variations 11 to 15, Variations 11 and 13 each use a length S that satisfies Formula (1) for a case in which n=1, that is, Formula (2), Variations 12 and 14 each use a length S that satisfies Formula (1) for a case in which n=2, and Variation 15 uses a length S that satisfies Formula (1) for a case in which n=3. The description below refers to (i) Variations 11 and 13 as a variation group that satisfies n=1, (ii) Variations 12 and 14 as a variation group that satisfies n=2, and (iii) Variation 15 as a variation that satisfies n=3.

A comparison between FIGS. 19 through 23 shows that a lower limit value for a frequency band in which return losses can be reduced to not more than −13 dB is the lowest (54.5 GHz and 55.5 GHz) for the variation group that satisfies n=1, shifted to the high-frequency side (58 GHz and 59.3 GHz) for the variation group that satisfies n=2, and shifted further to the high-frequency side (59.5 GHz) for the variation that satisfies n=3. This indicates that as compared to using a length S that satisfies n=2 or 3, using a length S that satisfies n=1 can extend, to the low-frequency side, a lower limit value for a frequency band in which return losses can be reduced to not more than −13 dB.

Of Variations 16 to 24, Variations 16 to 18 each use a length S that satisfies Formula (1) for a case in which n=1, that is, Formula (2), Variations 19 to 21 each use a length S that satisfies Formula (1) for a case in which n=2, and Variations 22 to 24 each use a length S that satisfies Formula (1) for a case in which n=3. The description below refers to (i) Variations 16 to 18 as a variation group that satisfies n=1, (ii) Variations 19 to 21 as a variation group that satisfies n=2, and (iii) Variations 22 to 24 as a variation group that satisfies n=3.

A comparison between FIGS. 24 through 26 shows that a lower limit value for a frequency band in which return losses can be reduced to not more than −13 dB is the lowest (51.7 GHz, 52.5 GHz, and 53.7 GHz) for the variation group that satisfies n=1, shifted to the high-frequency side (55.1 GHz, 55.6 GHz, and 56.3 GHz) for the variation group that satisfies n=2, and shifted further to the high-frequency side (56.2 GHz, 56.6 GHz, and 57.2 GHz) for the variation that satisfies n=3. This indicates that as compared to using a length S that satisfies n=2 or 3, using a length S that satisfies n=1 can extend, to the low-frequency side, a lower limit value for a frequency band in which return losses can be reduced to not more than −13 dB.

A comparison between (i) Variations 11 to 15, in each of which the protrusion amount P is 300 μm, and (ii) Variations 16 to 24, in each of which the protrusion amount P is 200 μm, shows that increasing the protrusion amount P can shift, to the high-frequency side, a frequency band in which a return loss can be reduced to not more than −13 dB and that decreasing the protrusion amount P can shift such a frequency band to the low-frequency side.

As described above, changing the protrusion amount P of a directional coupler 3 allows control of the frequency band. Stated differently, changing the protrusion amount makes it possible to easily control, without changing other parameters of the directional coupler, a frequency band in which return losses are reduced effectively. The protrusion amount P is preferably not more than 13.5% of the guide wavelength λg.

Configuration Example

Figure 27:
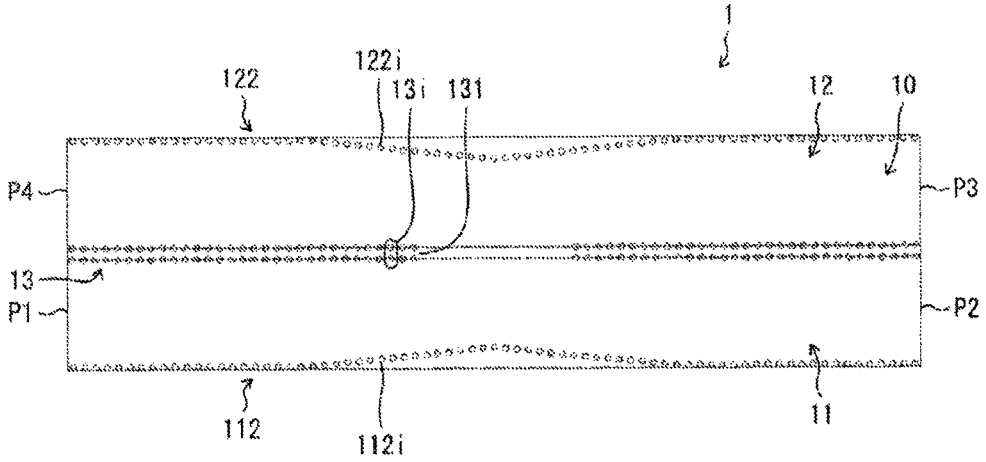
FIG. 27 is a top view illustrating an example configuration of a directional coupler in accordance with Embodiment 1 of the present invention.

With reference to FIG. 27, the following description will discuss a configuration example of the directional coupler 1 in accordance with Embodiment 1. FIG. 27 is a top view illustrating a configuration of the directional coupler 1 in accordance with the present configuration example.

Each of the first waveguide 11 and the second waveguide 12 included in the directional coupler 1 in accordance with the present configuration example is produced with use of a post-wall waveguide technique.

Specifically, the first waveguide 11 includes (i) the dielectric substrate 10, (ii) a pair of conductor plates (not illustrated in FIG. 27) provided on respective both sides of the dielectric substrate 10, (iii) a post wall obtained by providing a conductor post 112*i*, which penetrates the dielectric substrate 10, in a wall manner, and (iv) a post wall obtained by providing a conductor post 13*i* in a wall manner. In the present configuration example, the conductor post 13*i* consists of a pair of conductor posts.

The directional coupler 1 is configured such that when seen from above, conductor posts constituting the conductor post 112*i* are provided in such a manner that a line joining respective centers of the conductor posts corresponds to the shape of the narrow wall 112 illustrated in FIG. 1, and conductor posts constituting the conductor post 13*i* are provided in such a manner that a line joining respective centers of the conductor posts corresponds to the shape of the narrow wall 13 illustrated in FIG. 1.

Accordingly, the pair of conductor plates provided on respective both sides of the dielectric substrate 10 function as the wide walls 111*a* and 111*b*, respectively. The post wall obtained by providing the conductor post 13*i* in a wall manner functions as the narrow wall 13 which is the first narrow wall. The post wall obtained by providing the conductor post 112*i* in a wall manner functions as the narrow wall 112 which is the second narrow wall.

The second waveguide 12 includes (i) the dielectric substrate 10, (ii) a pair of conductor plates (not illustrated in FIG. 27) provided on respective both sides of the dielectric substrate 10, (iii) a post wall obtained by providing a conductor post 122*i*, which penetrates the dielectric substrate 10, in a wall manner, and (iv) a post wall obtained by providing a conductor post 13*i* in a wall manner. The second waveguide 12 is configured similarly to the first waveguide 11.

That is, the pair of conductor plates provided on respective both sides of the dielectric substrate 10 function as the wide walls 121*a* and 121*b*, respectively. The post wall obtained by providing the conductor post 13*i* in a wall manner functions as the narrow wall 13 which is the first narrow wall. That is, the first waveguide 11 and the second waveguide 12 share the narrow wall 13. The post wall obtained by providing the conductor post 122*i* in a wall manner functions as the narrow wall 122 which is the second narrow wall.

In the present configuration example, the conductor posts 112*i* and 122*i* and the conductor post 13*i* each have a diameter of 100 μm. A distance between the conductor post 112*i* and a conductor post 112*i*+1 which are adjacent to each other, a distance between the conductor post 122*i* and a conductor post 122*i*+1 which are adjacent to each other, and a distance between the conductor post 13*i* and a conductor post 13*i*+1 which are adjacent to each other are each 200 μm. However, these diameters and distances are not limited to those in the present configuration example, and may be determined appropriately depending on an operation frequency set at the time of the design.

In the present configuration example, the directional coupler 1 can be produced with use of a post-wall waveguide technique. Accordingly, it is possible to integrate, on a single dielectric substrate, the directional coupler 1 with other waveguide, band-pass filter etc. which are produced with use of the post-wall waveguide technique.

The directional coupler 1 is an H plane-coupled directional coupler in which the first waveguide 11 and the second waveguide 12 are coupled with each other via the opening 131 provided in the narrow wall 13 shared by the first waveguide 11 and the second waveguide 12. The H plane-coupled directional coupler 1 is preferable as a directional coupler produced with use of the post-wall waveguide technique, because the H plane-coupled directional coupler 1 can be produced with use of a single dielectric substrate 10.

The present configuration example described here is a case in which a post-wall waveguide technique is used for the directional coupler 1 in accordance with Embodiment 1. A post-wall waveguide technique is, however, usable not only for the directional coupler 1 but also the directional coupler 2 in accordance with Embodiment 1 and the directional coupler 3 in accordance with the reference embodiment.

Embodiment 3

With reference to FIG. 28, the following description will discuss a diplexer in accordance with Embodiment 3 of the present invention. (a) and (b) of FIG. 28 are each a block diagram showing a configuration of a diplexer 5 in accordance with the present embodiment.

As illustrated in (a) of FIG. 28, the diplexer 5 includes two directional couplers 1 in accordance with Embodiment 1, a first filter 51, and a second filter 52.

In the present embodiment, two directional couplers 1 are referred to as respective directional couplers 1*a* (first directional coupler) and 1*b* (second directional coupler) so as to be distinguished from each other. Furthermore, four ports of the directional coupler 1*a* are referred to as respective first through fourth ports P1*a* through P4*a*, and four ports of the directional coupler 1*b* are referred to as first through fourth ports P1*b* through P4*b* so as to be distinguished from each other.

The present embodiment employs, as the first and second filters 51 and 52, respective band-pass filters (BPF). Hereinafter, the first filter 51 is referred to as a BPF 51 and the second filter 52 is referred to as a BPF 52. The BPFs 51 and 52 transmit only high-frequency signals in a predetermined frequency band, and reflect high-frequency signals in other frequency bands than the predetermined frequency band.

The second port P2*a* of the directional coupler 1*a* is connected with the first port P1*b* of the directional coupler 1*b* via the BPF 51. The third port P3*a* of the directional coupler 1*a* is connected with the fourth port P4*b* of the directional coupler 1*b* via the BPF 52.

The BPFs 51 and 52 are configured so as to (i) transmit a high-frequency signal received by an antenna 63 and (ii) reflect a high-frequency signal received from a transmission circuit 61.

The following description will discuss what function is realized by the diplexer 5 configured as above. As illustrated in (a) of FIG. 28, the first port P1*a* of the directional coupler 1*a* is connected with the antenna 63, the fourth port P4*a* of the directional coupler 1*a* is connected with the transmission circuit 61 (Tx), the second port P2*b* of the directional coupler 1*b* is grounded via a terminal resistor 64, and the third port P3*b* of the directional coupler 1*b* is connected with a reception circuit 62 (Rx).

There are two paths from the first port P1*a* connected with the antenna 63 to the third port P3*b* connected with the reception circuit 62. A first path extends from the first port P1*a* to the third port P3*b*, via the second port P2*a*, the BPF 51, and the first port P1*b*. A second path extends from the first port P1*a* to the third port P3*b*, via the third port P3*a*, the BPF 52, and the fourth port P4*b*.

The diplexer 5 configured as above allows a high-frequency signal, which is received by the antenna 63 and is then input to the first port P1*a*, to arrive at the reception circuit 62.

Similarly, there are two paths from the fourth port P4*a* connected with the transmission circuit 61 to the first port P1*a* connected with the antenna 63. A first path is a path in which a high-frequency signal is reflected at an interface between the third port P3*a* and the BPF 52 and then arrives at the first port P1*a*. A second path is a path in which a high-frequency signal is reflected at an interface between the second port P2*a* and the BPF 51 and then arrives at the first port P1*a*.

The diplexer 5 configured as above allows a high-frequency signal, which is input to the fourth port P4*a* from the transmission circuit 61, to arrive at the antenna 63.

As described above, the diplexer 5 allows (i) a high-frequency signal having entered the first port P1*a* connected with the antenna 63 to exit from the third port P3*b* connected with the reception circuit 62 and (ii) a high-frequency signal having entered the fourth port P4*a* connected with the transmission circuit 61 to exit from the first port P1*a* connected with the antenna 63.

As described in the configuration example, the diplexer 5 is preferably prepared with use of the post-wall waveguide technique. The preparation of the diplexer 5 with use of the post-wall waveguide technique allows the directional couplers 1*a* and 1*b* and the BPFs 51 and 52 to be integrated on a single dielectric substrate. This allows (i) a reduction in cost for producing the diplexer 5 and (ii) an integration of the diplexer 5.

The diplexer 5 of the present embodiment described here includes directional couplers 1 in accordance with Embodiment 1 as the first directional coupler and the second directional coupler. The diplexer 5 may, however, alternatively include directional couplers 2 in accordance with Embodiment 2 or directional couplers 3 in accordance with the reference embodiment as the first directional coupler and the second directional coupler.

The diplexer 5 may alternatively be arranged such that as illustrated in (b) of FIG. 28, the fourth port P4*a* of the directional coupler 1*a* is connected with the reception circuit 62, and the third port P3*b* of the directional coupler 1*b* is connected with the transmission circuit 61. In this case, the BPFs 51 and 52 simply need to be arranged to (i) reflect a high-frequency signal received by the antenna 63 and (ii) allow passage of a high-frequency signal transmitted by the transmission circuit 61. The diplexer 5 illustrated in (b) of FIG. 28 has functions similar to those of the diplexer 5 illustrated in (a) of FIG. 28.

[Supplemental Notes]

The directional coupler in accordance with the reference embodiment of the present invention may alternatively be described as below.

A first aspect of the directional coupler in accordance with the reference embodiment of the present invention is a directional coupler, including: a first rectangular waveguide and a second rectangular waveguide sharing a first narrow wall having an opening, the first rectangular waveguide and the second rectangular waveguide each including a second narrow wall having a protruding part, the protruding part protruding toward the first narrow wall and including at least a portion of the opening, the protruding part having a length of not less than 1.68 times a width of the opening along a light-guiding direction.

In a case where a high-frequency signal having an operation frequency set at the time of the design is caused to enter one end of the first rectangular waveguide of the directional coupler arranged as above, S(1,1) and S(1,4) at the operation frequency set at the time of the design are sufficiently small. That is, this directional coupler can reduce a return loss at the operation frequency.

A second aspect of the directional coupler in accordance with the reference embodiment of the present invention may be arranged such that, in the first aspect, the protruding part of the second narrow wall protrudes toward the first narrow wall by a protrusion amount uniform across the protruding part.

The above arrangement makes it possible to reduce, with use of a step-type directional coupler, a return loss at the operation frequency set at the time of the design.

A third aspect of the directional coupler in accordance with the reference embodiment of the present invention may preferably be arranged such that, in the second aspect, in a case where the protruding part is divided into the following three parts: (1) an opening part having a beginning end and a finishing end at respective both ends of the opening, (2) a first non-opening part provided at a previous stage of the opening part and having a beginning end at one end of the protruding part and a finishing end at one end of the opening, and (3) a second non-opening part provided at a subsequent stage of the opening part and having a beginning end at the other end of the opening and a finishing end at the other end of the protruding part, the first non-opening part and the second non-opening part each have a length S satisfying the following Formula (1):

$$(\lambda g/2)\times n\times 0.8\leq S\leq S(\lambda g/2)\times n\times 1.2 \quad (1),$$

where λg is a guide wavelength for a case in which a high-frequency signal having a target operation frequency in design is guided in the first rectangular waveguide and the second rectangular waveguide, and n is a positive integer.

The above arrangement makes it possible to further prevent S(1,1) and S(1,4) at the operation frequency set at the time of the design.

A fourth aspect of the directional coupler in accordance with the reference embodiment of the present invention may preferably be arranged such that, in the third aspect, the protrusion amount is not more than 13.5% of the guide wavelength λg.

The above arrangement makes it possible to reliably prevent S(1,1) and S(1,4) at the operation frequency set at the time of the design.

Further, changing the protrusion amount within the above range makes it possible to control a frequency band which covers an operation frequency set at the time of the design and in which S(1,1) and S(1,4) are reduced effectively. Stated differently, changing the protrusion amount makes it possible to easily control, without changing other parameters of the directional coupler, a frequency band in which S(1,1) and S(1,4) are reduced effectively.

A fifth aspect of the directional coupler in accordance with the reference embodiment of the present invention may preferably be arranged such that, in any one of the first to fourth aspects, each of the first rectangular waveguide and the second rectangular waveguide has wide walls which are a pair of conductor plates provided on respective both sides of a dielectric substrate; and the first narrow wall and the second narrow walls each include conductor posts penetrating the dielectric substrate.

The directional coupler configured as above can be produced with use of a post-wall waveguide technique. Accordingly, production of such a directional coupler is easier than production of a directional coupler with use of metal waveguide tubes. This allows the directional coupler to be produced with a lower cost.

A diplexer in accordance with the reference embodiment of the present invention may preferably be a diplexer, including: a first directional coupler and a second directional coupler each of which is a directional coupler in accordance with any one of the first to fifth aspects; a first filter provided between (i) a first rectangular waveguide of the first directional coupler and (ii) a first rectangular waveguide of the second directional coupler; and a second filter provided between (a) a second rectangular waveguide of the first directional coupler and (b) a second rectangular waveguide of the second directional coupler.

With the above arrangement, the diplexer yields an effect similar to that of the directional coupler in accordance with any one of the aspects of the present invention.

[Recap]

In order to solve the above problem, a directional coupler in accordance with the present invention is a directional coupler, including: a first rectangular waveguide and a second rectangular waveguide sharing a first narrow wall having an opening, the first rectangular waveguide and the second rectangular waveguide each including a second narrow wall and having a width varying part resulting from the second narrow wall having a protruding part, the protruding part protruding toward the first narrow wall, the width varying part including at least a portion of the opening, the protruding part of the second narrow wall protruding toward the first narrow wall by a protrusion amount larger at a center of the width varying part than at both ends of the width varying part.

In a case where a high-frequency signal having an operation frequency set at the time of the design is caused to enter one end of the first rectangular waveguide of the directional coupler arranged as above, S(1,1) and S(1,4) at the operation frequency set at the time of the design are sufficiently small. That is, this directional coupler can reduce a return loss at the operation frequency.

It is preferable to arrange the directional coupler in accordance with one aspect of the present invention such that the protrusion amount increases continuously as farther from the both ends of the width varying part and closer to the center of the width varying part.

The above arrangement makes it possible to further prevent S(1,1) and S(1,4) at the operation frequency set at the time of the design.

The directional coupler according to an aspect of the present invention may be arranged such that the protrusion amount increases discretely as farther from the both ends of the width varying part and closer to the center of the width varying part.

The above arrangement makes it possible to further prevent S(1,1) and S(1,4) at the operation frequency set at the time of the design.

It is preferable to arrange the directional coupler in accordance with one aspect of the present invention such that the width varying part has a length not smaller than a width of the opening along a light-guiding direction.

The above arrangement makes it possible to shift, to the high-frequency side, a frequency band in which the directional coupler operates as a directional coupler.

It is preferable to arrange the directional coupler in accordance with one aspect of the present invention such that each of the first rectangular waveguide and the second rectangular waveguide has wide walls which are a pair of conductor plates provided on respective both sides of a dielectric substrate; and the first narrow wall and the second narrow walls each include conductor posts penetrating the dielectric substrate.

The directional coupler arranged as above can be produced with use of a post-wall waveguide technique. Producing a directional coupler in accordance with the present invention with use of a post-wall waveguide technique facilitates the production as compared to a case of producing a directional coupler with use of metal waveguide tubes. This allows the directional coupler to be produced with a lower cost.

Further, producing a directional coupler in accordance with the present invention with use of a post-wall waveguide technique makes it possible to integrate, on a single dielectric substrate, the directional coupler with other waveguide, band-pass filter etc. This in turn makes it possible to downsize a high-frequency transmission system including the directional coupler.

It is preferable to arrange a diplexer in accordance with one aspect of the present invention such that the diplexer includes: a first directional coupler and a second directional coupler each of which is a directional coupler according to any one of the aspects of the present invention; a first band-pass filter provided between (i) a first rectangular waveguide of the first directional coupler and (ii) a first rectangular waveguide of the second directional coupler; and a second band-pass filter provided between (a) a second rectangular waveguide of the first directional coupler and (b) a second rectangular waveguide of the second directional coupler.

With the above arrangement, the diplexer yields an effect similar to that of the directional coupler in accordance with any one of the aspects of the present invention.

The present invention is not limited to the embodiments, but can be altered by a skilled person in the art within the scope of the claims. An embodiment derived from a proper combination of technical means each disclosed in a different embodiment is also encompassed in the technical scope of the present invention.

INDUSTRIAL APPLICABILITY

The present invention is usable for a directional coupler including two rectangular waveguides. Furthermore, the present invention is usable for a diplexer including such directional couplers.

REFERENCE SIGNS LIST

1, 2, 3 directional coupler
11, 21, 31 first waveguide (first rectangular waveguide)
11*a*, 21*a*, 31*a* first part
11*b*, 21*b*, 31*b* protruding part
31*b*0 opening part
31*b*1 first non-opening part
31*b*2 second non-opening part
11*c*, 21*c*, 31*c* second part
111*a*, 111*b*, 211*a*, 211*b*, 311*a*, 311*b* wide wall
112, 212, 312 narrow wall (second narrow wall)
12, 22, 32 second waveguide (second rectangular waveguide)
12*a*, 22*a*, 32*a* first part
12*b*, 22*b*, 32*b* protruding part
32*b*0 opening part
32*b*1 first non-opening part
32*b*2 second non-opening part
12*c*, 22*c*, 32*c* second part
121*a*, 121*b*, 221*a*, 221*b*, 321*a*, 321*b* wide wall
122, 222, 322 narrow wall (second narrow wall)
13, 23, 33 narrow wall (first narrow wall)
131, 231, 331 opening
5 diplexer
51, 52 BPF (band-pass filter)
P1, P1*a*, P1*b* first port
P2, P2*a*, P2*b* second port
P3, P3*a*, P3*b* third port
P4, P4*a*, P4*b* fourth port

The invention claimed is:

1. A diplexer, comprising:

a first directional coupler and a second directional coupler each comprising:

a first rectangular waveguide and a second rectangular waveguide sharing a first narrow wall having an opening, the first rectangular waveguide and the second rectangular waveguide each including a second narrow wall and having a width varying part resulting from the second narrow wall having a protruding part protruding toward the first narrow wall, the width varying part including at least a portion of the opening, the protruding part of the second narrow wall protruding toward the first narrow wall by a protrusion amount larger at a center of the width varying part than at both ends of the width varying part, wherein:

each of the first rectangular waveguide and the second rectangular waveguide has wide walls which are a pair of conductor plates provided on respective both sides of a dielectric substrate; and the first narrow wall and the second narrow walls each include conductor posts penetrating the dielectric substrate;

a first band-pass filter provided between (i) the first rectangular waveguide of the first directional coupler and (ii) the first rectangular waveguide of the second directional coupler; and a second band-pass filter provided between (a) the second rectangular waveguide of the first directional coupler and (b) the second rectangular waveguide of the second directional coupler.

2. A directional coupler, comprising:

a first rectangular waveguide and a second rectangular waveguide sharing a first narrow wall having an opening, the first rectangular waveguide and the second rectangular waveguide each including a second narrow wall and having a width varying part resulting from the second narrow wall having a protruding part protruding toward the first narrow wall, the width varying part including at least a portion of the opening, the protruding part of the second narrow wall protruding toward the first narrow wall by a protrusion amount larger at a center of the width varying part than at both ends of the width varying part, wherein the protrusion amount becomes continuously larger as farther from the both ends of the width varying part and closer to the center of the width varying part, the directional coupler further comprising: a protruding section which is provided at the center of the width varying part and at both ends of which the protrusion amount becomes discretely larger.

3. The directional coupler according to claim 2, wherein the width varying part has a length not smaller than a width of the opening along a light-guiding direction.

4. The directional coupler according to claim 2, wherein:

each of the first rectangular waveguide and the second rectangular waveguide has wide walls which are a pair of conductor plates provided on respective both sides of a dielectric substrate; and the first narrow wall and the second narrow walls each include conductor posts penetrating the dielectric substrate.

5. A diplexer, comprising:

a first directional coupler and a second directional coupler each comprising:

a first rectangular waveguide and a second rectangular waveguide sharing a first narrow wall having an opening, the first rectangular waveguide and the second rectangular waveguide each including a second narrow wall and having a width varying part resulting from the second narrow wall having a protruding part protruding toward the first narrow wall, the width varying part including at least a portion of the opening, the protruding part of the second narrow wall protruding toward the first narrow wall by a protrusion amount larger at a center of the width varying part than at both ends of the width varying part, wherein the protrusion amount becomes continuously larger as farther from the both ends of the width varying part and closer to the center of the width varying part, the directional coupler further comprising: a protruding section which is provided at the center of the width varying part and at both ends of which the protrusion amount becomes discretely larger;

a first band-pass filter provided between (i) the first rectangular waveguide of the first directional coupler and (ii) the first rectangular waveguide of the second directional coupler; and a second band-pass filter provided between (a) the second rectangular waveguide of the first directional coupler and (b) the second rectangular waveguide of the second directional coupler.

* * * * *